US007606509B2

(12) United States Patent
Yako

(10) Patent No.: US 7,606,509 B2
(45) Date of Patent: Oct. 20, 2009

(54) IMAGE FORMING APPARATUS, RECORDING MATERIAL CONVEYING METHOD, PROGRAM FOR IMPLEMENTING THE METHOD, AND STORAGE MEDIUM STORING THE PROGRAM

(75) Inventor: Yasuhiro Yako, Adachi-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 11/530,490

(22) Filed: Sep. 11, 2006

(65) Prior Publication Data

US 2007/0071468 A1 Mar. 29, 2007

(30) Foreign Application Priority Data

Sep. 12, 2005 (JP) ..... 2005-264405

(51) Int. Cl.
*G03G 15/20* (2006.01)

(52) U.S. Cl. ..... 399/68

(58) Field of Classification Search ..... 399/43–45, 399/67–69

See application file for complete search history.

(56) References Cited

U.S. PATENT DOCUMENTS

| | | | | |
|---|---|---|---|---|
| 6,389,241 | B1 * | 5/2002 | Cernusak et al. | 399/44 |
| 6,978,114 | B2 * | 12/2005 | Okamoto et al. | 399/389 |
| 7,218,873 | B2 | 5/2007 | Iwasaki et al. | |
| 7,313,339 | B2 * | 12/2007 | Nishiyama | 399/68 |
| 7,359,654 | B2 | 4/2008 | Iwasaki | |
| 2004/0190924 | A1 * | 9/2004 | Iwasaki et al. | 399/68 |
| 2005/0191070 | A1 * | 9/2005 | Izawa et al. | 399/44 |
| 2005/0281595 | A1 * | 12/2005 | Kachi | 399/329 |
| 2006/0188280 | A1 | 8/2006 | Hayakawa et al. | |
| 2007/0059008 | A1 | 3/2007 | Iwasaki et al. | |
| 2007/0071475 | A1 * | 3/2007 | Blair et al. | 399/68 |
| 2008/0031648 | A1 | 2/2008 | Iwasaki et al. | |

FOREIGN PATENT DOCUMENTS

| | | | |
|---|---|---|---|
| CN | 1534404 | A | 10/2004 |
| JP | 01-149081 | A | 6/1989 |
| JP | 2003091212 | A | 3/2003 |

OTHER PUBLICATIONS

Notification of First Office Action, dated Jul. 4, 2008, issued in corresponding CN application no. 2006101272244.

* cited by examiner

*Primary Examiner*—David M Gray
*Assistant Examiner*—Andrew V Do
(74) *Attorney, Agent, or Firm*—Rossi, Kimms & McDowell, LLP

(57) ABSTRACT

An image forming apparatus which can prevent a temperature increase at predetermined locations of a fixing unit and also realize the fastest printing with respect to each continuous printing number. The image forming apparatus includes a fixing unit that fixes an image supported on a recording material passing through the nip section, and a conveying unit that conveys the recording material to the fixing unit at a throughput representing the number of recording materials conveyed to the fixing unit per unit time. The printing number is set in continuous printing on the recording materials, and the size of the recording material is acquired. Nearly the highest throughput is set as the predetermined throughput based on the set printing numbers and the acquired size of the recording material so that the continuous printing is completed before a temperature at predetermined locations in the fixing unit reaches an upper limit.

7 Claims, 44 Drawing Sheets

FIG. 5

| SHEET SIZE | CONTINUOUS PRINTING NUMBER | THROUGHPUT |
|---|---|---|
| LTR-R | 1～20 | 20ppm |
| | 21～40 | 18ppm |
| | 41～60 | 16ppm |
| | 61～80 | 14ppm |
| | 81～99 | 12ppm |
| A4-R | 1～20 | 18ppm |
| | 21～40 | 16ppm |
| | 41～60 | 14ppm |
| | 61～80 | 12ppm |
| | 81～99 | 10ppm |
| LGL | 1～20 | 16ppm |
| | 21～40 | 14ppm |
| | 41～60 | 12ppm |
| | 61～80 | 10ppm |
| | 81～99 | 9ppm |

FIG. 7A

COMMAND INDICATIVE OF CONTINUOUS PRINTING NUMBER

| | |
|---|---|
| 1st bit | ERROR BIT |
| 2nd bit | 1 |
| 3rd bit | 1 |
| 4th bit | 1 |
| 5th bit | 1 |
| 6th bit | 1 |
| 7th bit | 1 |
| 8h bit | CONTINUOUS PRINTING NUMBER |
| 9h bit | |
| 10h bit | |
| 11h bit | |
| 12h bit | |
| 13h bit | |
| 14h bit | |
| 15h bit | |
| 16h bit | PARITY BIT |

FIG. 7B

COMMAND INDICATIVE OF RECORDING SHEET SIZE

| | |
|---|---|
| 1st bit | ERROR BIT |
| 2nd bit | 1 |
| 3rd bit | 1 |
| 4th bit | 1 |
| 5th bit | 1 |
| 6th bit | 1 |
| 7th bit | 0 |
| 8h bit | RECORDING SHEET SIZE |
| 9h bit | |
| 10h bit | |
| 11h bit | |
| 12h bit | |
| 13h bit | |
| 14h bit | |
| 15h bit | |
| 16h bit | PARITY BIT |

FIG. 18

| SHEET SIZE | CONTINUOUS PRINTING NUMBER | THROUGHPUT | |
|---|---|---|---|
| LTR-R | 1～20 | 20ppm | AMBIENT TEMPERATURE =15°C |
| | 21～40 | 18ppm | |
| | 41～60 | 16ppm | |
| | 61～80 | 14ppm | |
| | 81～99 | 12ppm | |
| | 1～20 | 16ppm | AMBIENT TEMPERATURE =40°C |
| | 21～40 | 14ppm | |
| | 41～60 | 12ppm | |
| | 61～80 | 10ppm | |
| | 81～99 | 9ppm | |
| A4-R | 1～20 | 18ppm | AMBIENT TEMPERATURE =15°C |
| | 21～40 | 16ppm | |
| | 41～60 | 14ppm | |
| | 61～80 | 12ppm | |
| | 81～99 | 10ppm | |
| | 1～20 | 18ppm | AMBIENT TEMPERATURE =40°C |
| | 21～40 | 16ppm | |
| | 41～60 | 14ppm | |
| | 61～80 | 12ppm | |
| | 81～99 | 10ppm | |

FIG. 19

SHEET TYPE COMMAND

| | |
|---|---|
| 1st bit | ERROR BIT |
| 2nd bit | 1 |
| 3rd bit | 1 |
| 4th bit | 1 |
| 5th bit | 1 |
| 6th bit | 0 |
| 7th bit | 0 |
| 8h bit | SHEET TYPE |
| 9h bit | |
| 10h bit | |
| 11h bit | |
| 12h bit | |
| 13h bit | |
| 14h bit | |
| 15h bit | |
| 16h bit | PARITY BIT |

*FIG. 20*

| SHEET TYPE | SHEET SIZE | AMBIENT TEMPERATURE | CONTINUOUS PRINTING NUMBER | THROUGHPUT TIMER |
|---|---|---|---|---|
| THICK SHEET | LTR-R | LESS THAN 15℃ | 1～20 | Top-topTIME−1 |
| | | | 21～40 | Top-topTIME−2 |
| | | | 41～60 | Top-topTIME−3 |
| | | | 61～80 | Top-topTIME−4 |
| | | | 81～99 | Top-topTIME−5 |
| | | NOT LESS THAN 15℃ | 1～20 | Top-topTIME−6 |
| | | | 21～40 | Top-topTIME−7 |
| | | | 41～60 | Top-topTIME−8 |
| | | | 61～80 | Top-topTIME−9 |
| | | | 81～99 | Top-topTIME−10 |
| | A4-R | LESS THAN 15℃ | 1～20 | Top-topTIME−11 |
| | | | 21～40 | Top-topTIME−12 |
| | | | 41～60 | Top-topTIME−13 |
| | | | 61～80 | Top-topTIME−14 |
| | | | 81～99 | Top-topTIME−15 |
| | | NOT LESS THAN 15℃ | 1～20 | Top-topTIME−16 |
| | | | 21～40 | Top-topTIME−17 |
| | | | 41～60 | Top-topTIME−18 |
| | | | 61～80 | Top-topTIME−19 |
| | | | 81～99 | Top-topTIME−20 |
| PLAIN SHEET | LTR-R | LESS THAN 15℃ | 1～20 | Top-topTIME−21 |
| | | | 21～40 | Top-topTIME−22 |
| | | | 41～60 | Top-topTIME−23 |
| | | | 61～80 | Top-topTIME−24 |
| | | | 81～99 | Top-topTIME−25 |
| | | NOT LESS THAN 15℃ | 1～20 | Top-topTIME−26 |
| | | | 21～40 | Top-topTIME−27 |
| | | | 41～60 | Top-topTIME−28 |
| | | | 61～80 | Top-topTIME−29 |
| | | | 81～99 | Top-topTIME−30 |
| | A4-R | | 1～20 | Top-topTIME−31 |

FIG. 27

| ADDRESS | ppm | X (TIME) | Y (NUMBER OF SHEETS) |
|---|---|---|---|
| 0 | 20 | T1 | N1 |
| 1 | 5 | XX1=(N1−5*T1)/14 | YY1=19*(N1−5*T1)/14 |
| 2 | 19 | T2 | N2 |
| 3 | 5 | XX2=(N2−5*T2)/13 | YY2=18*(N2−5*T2)/13 |
| 4 | 18 | T3 | N3 |
| 5 | 5 | XX3=(N3−5*T3)/12 | YY3=17*(N3−5*T3)/12 |
| 6 | 17 | T4 | N4 |
| 7 | 5 | XX4=(N4−5*T4)/11 | YY4=16*(N4−5*T4)/11 |
| 8 | 16 | T5 | N5 |
| 9 | 5 | XX5=(N5−5*T5)/10 | YY5=15*(N5−5*T5)/10 |
| 10 | 15 | T6 | N6 |
| 11 | 5 | XX6=(N6−5*T6)/9 | YY6=14*(N6−5*T6)/9 |
| 12 | 14 | T7 | N7 |
| 13 | 5 | XX7=(N7−5*T7)/8 | YY7=13*(N7−5*T7)/8 |
| 14 | 13 | T8 | N8 |
| 15 | 5 | XX8=(N8−5*T8)/7 | YY8=12*(N8−5*T8)/7 |
| 16 | 12 | T9 | N9 |
| 17 | 5 | XX9=(N9−5*T9)/6 | YY9=11*(N9−5*T9)/6 |
| | | | |

IMAGE FORMING APPARATUS, RECORDING MATERIAL CONVEYING METHOD, PROGRAM FOR IMPLEMENTING THE METHOD, AND STORAGE MEDIUM STORING THE PROGRAM

BACKGROUND OF THE INVENTION

1. Field of the Invention

The present invention relates to an image forming apparatus and a recording material conveying method, which conveys a recording material to a fixing unit that fixes an image held on a recording material, as well as a program for implementing the method and a storage medium storing the program.

2. Description of the Related Art

Conventionally, a fixing unit mounted in an image forming apparatus is comprised mainly of two fixing rollers. One of the two fixing rollers has a heater incorporated therein. This heater comprises a heat roller 901 (see FIG. 40) that generates heat when energized. It should be noted that a cylindrical film may be used in place of the heat roller. The other of the two fixing rollers comprises a pressurizing roller 902 that is pressure-cotacted urging contact with the heat roller 901 so as to form a nip section in the area of contact between the two fixing rollers. FIG. 40 is a diagram showing the axial direction-wise temperature distribution in the nip section of the conventional fixing unit.

A recording material that holds a toner receives heat and pressure when passing through the nip section of the two fixing rollers, and the toner is fixed on the recording material by the heat and pressure. Based on temperature data from a thermistor, the fixing unit controls the fixing temperature so as to ensure a fixing temperature necessary and sufficient for the toner to be properly fixed on the recording material.

The size of the recording sheet passing through the fixing unit varies from a relatively large A3-size to a relatively small postcard size. Thus, depending on the size of a recording material, the recording material is in contact with some areas of the nip section but is not in contact with the other areas of the nip section. In the case where recording materials of any size are caused to pass through the midsection of the fixing rollers in the axial direction, the thermistor for controlling the fixing temperature is usually disposed in the midsection of the fixing rollers in the axial direction. Referring to FIG. 40, a first thermistor 903 is disposed in the midsection of the fixing rollers in the axial direction. Also, a second thermistor 904 is disposed at an end of the fixing rollers in the axial direction.

The reason why the second thermistor 904 is disposed at the end of the fixing rollers is as follows. If no recording material is present in the fixing unit, the axial direction-wise temperature distribution of the nip section is substantially uniform (see FIG. 40). This is because the heater is configured to uniformly generate heat in the axial direction. Conventionally, such a heater is widely used for fixing units so as to reduce costs, enhance ease of control, and realize high durability, etc.

FIG. 41 is a diagram showing the axial direction-wise distribution in the nip section when a recording material passes through the midsection of the fixing rollers. When a recording material 910 passes through the midsection of the fixing rollers, heat is drawn from the midsection by the recording material 901, and therefore the temperature in the midsection decreases. On this occasion, the first thermistor 903 detects the temperature decrease in the midsection, and hence the quantity of electric current passed through the heater is increased to generate much more heat so as to keep a predetermined fixing temperature. On the other hand, no heat is drawn from the ends of the fixing rollers by the recording material 910, and hence the temperature at the ends of the fixing rollers (hereinafter merely referred to as "the end temperature") does not decrease. That is, the distribution of temperature is such that the temperature is low in the midsection of the rollers and is high at the ends of the fixing rollers.

FIG. 42 is a diagram showing the axial direction-wise temperature distribution in the nip section in the case where recording sheets are continuously passed through the fixing unit. In the case where recording sheets are continuously passed through the fixing unit, no heat is drawn from the midsection of the fixing rollers in the interval between a certain recording material and the next recording material (i.e. sheet-to-sheet interval), and hence the temperature in the midsection does not decrease, and the heater generates only a small amount of heat. Also, the end temperature does not increase due in part to the shift of heat at the ends of the fixing rollers shift to the midsection where the temperature is low. As a result, the temperature distribution becomes nearly flat.

As described above, the end temperature tends to increase in the case where the width of a recording sheet is smaller than the axial width of the fixing rollers. It is known that when the end temperature exceeds a predetermined upper limit, this will cause a failure of the fixing unit. Accordingly, a scheme to prevent temperature increase at the ends of the fixing rollers in the axial direction has to be devised, and such a scheme has been proposed (see Japanese Laid-Open Patent Publication (Kokai) No. H01-149081). Since the end temperature increases when a recording material passes through the nip section and decreases in the sheet-to-sheet interval, temperature increase at the ends of the fixing rollers can be prevented by keeping some interval between a precedent recording material and the next recording material (i.e. sheet-to-sheet interval) when recording materials are continuously passed through the fixing unit. According to the scheme proposed in the Japanese Laid-Open Patent Publication (Kokai) No. H01-149081, the throughput in continuous printing is fixed with respect to each recording sheet size, and when an increase in end temperature occurs during conveyance, the throughput is decreased so as to decrease the end temperature. Also, an increase in end temperature is suppressed by providing longer sheet-to-sheet intervals for narrower recording sheets.

FIG. 43A is a diagram showing states in which recording sheets are conveyed at different sheet-to-sheet intervals, and FIG. 43B is a diagram showing the number of recording sheets conveyed per minute with respect to each sheet-to-sheet interval. Here, the number of recording sheets conveyed per minute is expressed in the unit ppm (page per minute) and is referred to as the throughput. If recording sheets are equal in length, the throughput increases as the sheet-to-sheet interval decreases, and conversely, the throughput decreases as the sheet-to-sheet interval increases.

FIG. 44 is a graph showing a state in which the end temperature decreases as the sheet-to-sheet interval increases in continuous printing. In FIG. 44, sheet passages and sheet-to-sheet intervals are enlarged so as to make the explanation easier to understand. When a recording sheet is passed through the fixing unit, the end temperature increases, and in the sheet-to-sheet interval, the end temperature decreases. The end temperature is repeatedly changed in this manner to gradually increase. Also, the end temperature represented by the graph G with a shorter sheet-to-sheet interval reaches an upper limit (210° C.) earlier than the end temperature represented by the graph H with a longer sheet-to-sheet interval. Thus, the degree of increase in end temperature varies with sheet-to-sheet intervals.

FIG. 45 is a graph showing the relationship between the throughput and the end temperature. When the throughput is 20 ppm, the end temperature reaches the upper limit of 210° C. at a time TD1; 18 ppm, TD2; 16 ppm, TD3; and 14 ppm, TD4. Thus, as the throughput decreases, the ascending curve of the end temperature becomes slighter, and also, the time it takes for the end temperature to reach the upper limit of 210° C. increases.

In Japanese Laid-Open Patent Publication (Kokai) No. H01-149081 described above, continuous sheet conveyance is started at a fixed throughput suitable for the recording sheet size, and when the end temperature reaches an upper limit during the sheet conveyance, the throughput is decreased so as to prevent an increase in end temperature. According to this method, if the continuous printing number is small, continuous printing at a high throughput can be realized, but if the continuous printing number is large, the throughput has to be decreased during sheet conveyance. As a result, the average throughput in continuous printing as a whole is low.

FIG. 46 is a graph showing the relationship between the continuous printing number and the printing time. The ordinate indicates the continuous printing number, and the abscissa indicates the printing time. The slope of each line corresponds to the number of prints produced per unit time, i.e. the throughput. For example, since the end temperature reaches the upper limit (210° C.) at the time TD1 if printing is started at a throughput of 20 ppm, the throughput is decreased to 5 ppm after the time TD1. At a point a in FIG. 46, the throughput is decreased from 20 ppm to 5 ppm, and the slope of a corresponding line becomes gentle. If it has been found by experiment that when the throughput is decreased to 5 ppm, the end temperature decreases from 210° C. and becomes stable at a temperature lower than 210° C., the remaining recording sheets are conveyed at 5 ppm.

In the case where, for example, 99 prints are produced in the above described manner, printing on the 99th recording sheet ends at a time T1. The throughput from an origin point to the point a is 20 ppm, and the throughput from the point a to an ending point I is 5 ppm. If printing is started at a throughput of 18 ppm and printing on the same 99 recording sheets is carried out, the slope of a line representing the number of prints produced per minute is gentle. In this case, since the sheet-to-sheet interval is longer and the increase in end temperature is smaller than in the case where the throughput is 20 ppm, the end temperature reaches the upper limit of 210° C. at a time TD2 which is later than in the case where the throughput is 20 ppm. If the throughput is decreased to 5 ppm at a point b corresponding to the time TD2, the slope of a line representing the number of prints produced per minute is the same as in the case where the throughput is 20 ppm. Thus, printing on the 99th recording sheet ends at a time T2, which is earlier than the time T1. From then on, the throughput is decreased in the same manner, points at which printing on the 99th recording sheet ends are I, II, III, IV, and V in FIG. 46. Thus, if printing is started at 12 ppm, the line does not bend (i.e. the throughput does not decrease) until printing on the 99th recording sheet ends at the point V, and continuous printing on 99 recording sheets is completed at the earliest time T5. Thus, in continuously producing 99 prints, the time it takes to complete printing on all the 99 sheets in the case where the throughput is 12 ppm is shorter than in the case where the throughput is 20 ppm.

As described above, according to the above conventional art, recording sheets are conveyed in continuous printing at a fixed throughput which is determined with respect to each recording sheet size, and therefore, if the continuous printing number is large, the end temperature increases during sheet conveyance, and hence the throughput has to be decreased during conveyance so as to decrease the end temperature. As a result, it takes long time to complete printing, and it is impossible to control conveyance in the optimum manner with respect to each number of prints to be continuously produced, that is, it is impossible to control conveyance such that printing is completed within the minimum period of time. Specifically, according to the conventional art, a fixed and fastest throughput cannot be set until continuous printing is completed, since an increase in end temperature to exceed an upper limit has to be prevented.

Further, since the proper fixing temperature and the increase in end temperature increase varies with sheet types such as a thick sheet, a thin sheet, and an OHP sheet, the throughput has been controlled to be changed according to sheet type at the start of printing, a decrease in throughput during sheet conveyance cannot be avoided when the continuous printing number is large.

SUMMARY OF THE INVENTION

It is therefore an object of the present invention to provide an image forming apparatus and a recording sheet conveying method, which is capable of preventing a temperature increase at predetermined locations of a fixing unit and also realizing the fastest printing with respect to each continuous printing number, as well as a program for implementing the method and a storage medium storing the program.

To attain the above object, in a first aspect of the present invention, there is provided an image forming apparatus including a fixing unit that comprises two roller members which form a nip section and at least one of which is heated, the fixing unit fixing an image held on a recording material when the recording material passes through the nip section, and a conveying unit that conveys the recording material to the fixing unit at a throughput representing the number of recording materials conveyed to the fixing unit per unit time, the image forming apparatus comprising: a continuous printing number setting unit that sets the printing number of recording materials to be passed through the nip section in continuous printing on the recording materials; a size acquiring unit that acquires a size of the recording material; and a throughput setting unit that sets the throughput based on the set printing number and the acquired size of the recording material so that the continuous printing is completed before a temperature at predetermined locations in the fixing unit reaches an upper limit.

To attain the above object, in a second aspect of the present invention, there is provided an image forming apparatus including a fixing unit that comprises two roller members which form a nip section and at least one of which is heated, the fixing unit fixing an image held on a recording material when the recording material passes through the nip section, and a conveying unit conveys the recording material to the fixing unit at a throughput representing the number of recording materials conveyed to the fixing unit per unit time, the image forming apparatus comprising: a throughput changing unit that, in performing continuous printing while changing a rising throughput at which a temperature at predetermined locations in the fixing unit reaches an upper limit, gradually decreases the rising throughput with a falling throughput at which the temperature at predetermined locations does not reach the upper limit being interposed between throughput changes.

To attain the above object, in a third aspect of the present invention, there is provided a recording material conveying method that conveys a recording material to a fixing unit at a throughput representing the number of recording materials conveyed to the fixing unit per unit time, the fixing unit comprising two roller members which form a nip section and at least one of which is heated and fixing an image supported on the recording material when the recording material passes through the nip section, the method comprising: a continuous printing number setting step of setting the printing number of recording materials to be passed through the nip section in continuous printing on the recording materials; a size acquiring step of acquiring s a size of the recording material; and a throughput setting step of the throughput based on the set printing number and the acquired size of the recording material so that the continuous printing is completed before a temperature at predetermined locations in the fixing unit reaches an upper limit.

To attain the above object, in a fourth aspect of the present invention, there is provided a recording material conveying method that conveys a recording material to a fixing unit at a throughput representing the number of recording materials conveyed to the fixing unit per unit time, the fixing unit comprising two roller members which form a nip section and at least one of which is heated and fixing an image held on the recording material when the recording material passes through the nip section, the method comprising: a throughput changing unit step of, in performing continuous printing while changing a rising throughput at which a temperature at predetermined locations in the fixing unit reaches an upper limit, gradually decreasing the rising throughput with a falling throughput at which the temperature at predetermined locations does not reach the upper limit being interposed between throughput changes.

To attain the above object, in a fifth aspect of the present invention, there is provided a program for causing a computer to execute a recording material conveying method that conveys a recording material to a fixing unit at a throughput representing the number of recording materials conveyed to the fixing unit per unit time, the fixing unit comprising two roller members which form a nip section and at least one of which is heated and fixing an image supported on the recording material when the recording material passes through the nip section, the program comprising: a continuous printing number of setting module for setting the printing number of recording materials to be passed through the nip section in continuous printing on the recording materials; a size acquiring module for acquiring s a size of the recording material; and a throughput setting module for setting the throughput based on the set printing number and the acquired size of the recording material so that the continuous printing is completed before a temperature at predetermined locations in the fixing unit reaches an upper limit.

To attain the above object, in a sixth aspect of the present invention, there is provided a program for causing a computer to execute a recording material conveying method that conveys a recording material to a fixing unit at a throughput representing the number of recording materials conveyed to the fixing unit per unit time, the fixing unit comprising two roller members which form a nip section and at least one of which is heated and fixing an image held on the recording material when the recording material passes through the nip section, the program comprising: a throughput changing module for, in performing continuous printing while changing a rising throughput at which a temperature at predetermined locations in the fixing unit reaches an upper limit, gradually decreasing the rising throughput with a falling throughput at which the temperature at predetermined locations does not reach the upper limit being interposed between throughput changes.

To attain the above object, in a seventh aspect of the present invention, there is provided a computer-readable storage medium storing the above-mentioned program.

With the arrangement of the first aspect of the present invention, in performing continuous printing, the number of prints produced with the recording materials to be passed through the nip section is set, the size of the recording material is acquired, and the throughput which causes the continuous printing to be completed before the temperature at the predetermined locations in the fixing unit reaches the upper limit is set based on the set number of prints and the acquired size of the recording material. As a result, it is capable of realizing the fastest printing can be realized with respect to each number of prints to be continuously produced while reliably preventing an increase in temperature at the predetermined locations (i.e. at the ends of the rollers), thereby improving the productivity.

According to a preferred form of the present invention, the fastest printing can be realized irrespective of the type of recording material. According to a preferred form of the present invention, the fastest printing can be realized irrespective of the ambient temperature. According to a preferred form of the present invention, the highest throughput can be set even for irregular-size recording materials.

With the arrangement of the second aspect of the present invention, in performing continuous printing while changing the rising throughput at which the temperature at the predetermined locations in the fixing unit, the rising throughput is gradually decreased with the falling throughput at which the temperature at the predetermined locations does not reach the upper limit being interposed between throughput changes. As a result, it is capable of realizing the fastest printing with respect to each number of prints to be continuously produced while reliably preventing an increase in temperature at the predetermined locations (i.e. at the ends of the rollers), thereby improving the productivity. Furthermore, it is possible to easily cope with a situation where the continuous printing number is changed during printing.

Other features and advantages of the present invention will be apparent from the following description taken in conjunction with the accompanying drawings, in which like reference characters designate the same or similar parts through the figures thereof.

BRIEF DESCRIPTION OF THE DRAWINGS

The accompanying drawings, which are incorporated in and constitute a part of the specification, illustrate an embodiment of the present invention and, together with the description, serve to explain the principles of the present invention.

FIG. 5 is a table showing the optimum throughput with respect to each recording sheet size of regular-size sheet and each number of prints to be continuously produced.

FIGS. 7A and 7B are views showing a command indicative of a continuous printing number and a command indicative of a recording sheet size received in a step S1 and a step S2, respectively.

FIG. 18 is a table showing the optimum throughput with respect to each recording sheet size of regular-size sheet and each number of prints to be continuously produced in the case where the ambient temperature is taken into consideration.

FIG. 19 is a view showing a sheet type command according to a second embodiment of the present invention.

FIG. 20 is a table showing throughputs, which is stored in a table memory 731 within an engine controller.

FIG. 27 is a table showing coordinates at respective points in FIG. 26.

DETAILED DESCRIPTION OF THE PREFERRED EMBODIMENTS

Embodiments of an image forming apparatus and a recording material conveying method according to the present invention will be described with reference to the drawings. The image forming apparatus according to the present invention is applied to a multifunction peripheral (MFP).

Figure 1:
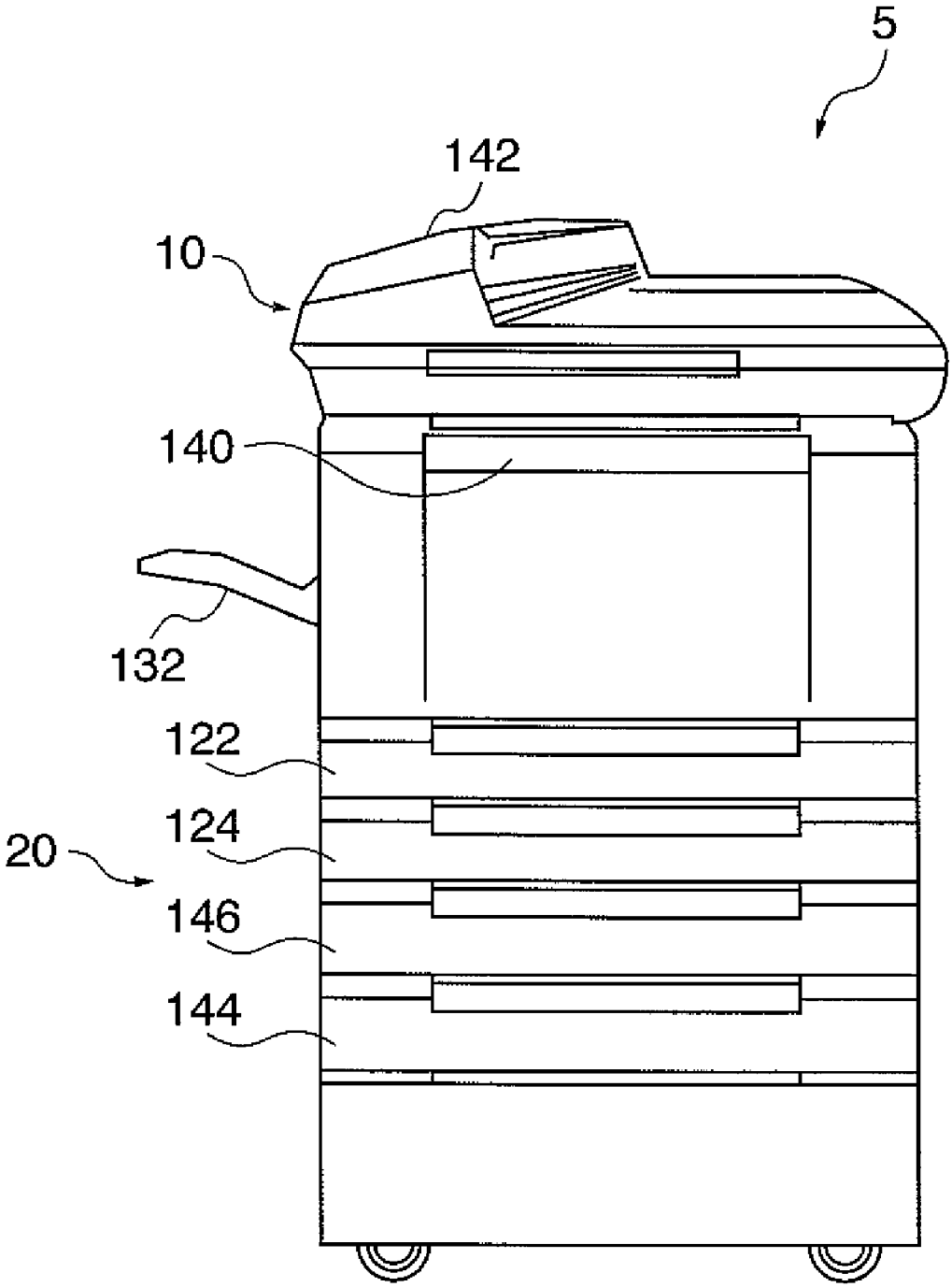
FIG. 1 is a view showing the appearance of a multifunction peripheral 5 according to a first embodiment of the present invention.

FIG. 1 is a view showing the appearance of a multifunction peripheral 5 according to a first embodiment of the present invention. The multifunction peripheral 5 is comprised of a scanner section 10 which is an image input device, and a printer section 20 which is an image output device. The scanner section 10 illuminates an image on an original with a lamp, reads reflected light from the original with a CCD line sensor (hereinafter merely referred to as "the CCD"), and converts the reflected light into an electric signal, thereby processing the image on the original as image data. In reading originals, when a user places original sheets on an original feeder 142 and gives an instruction for starting reading, the original feeder 142 feeds the original sheets one by one.

The printer section 20 is intended to convert image data into an image on a recording sheet, and in the present embodiment, performs printing by an electrophotographic process using a photosensitive drum or photosensitive belt. Printing is started in response to an instruction from a controller unit 30 provided in the apparatus. The printer section 20 is equipped with a plurality of sheet trays so as to select different sheet sizes or different sheet orientations; i.e. sheet cassettes (sheet feed units) 122, 124, 146, and 144 are provided for respective sheet sizes or sheet orientations. A sheet with an image formed thereon is discharged onto a sheet discharge tray 132.

Figure 2:
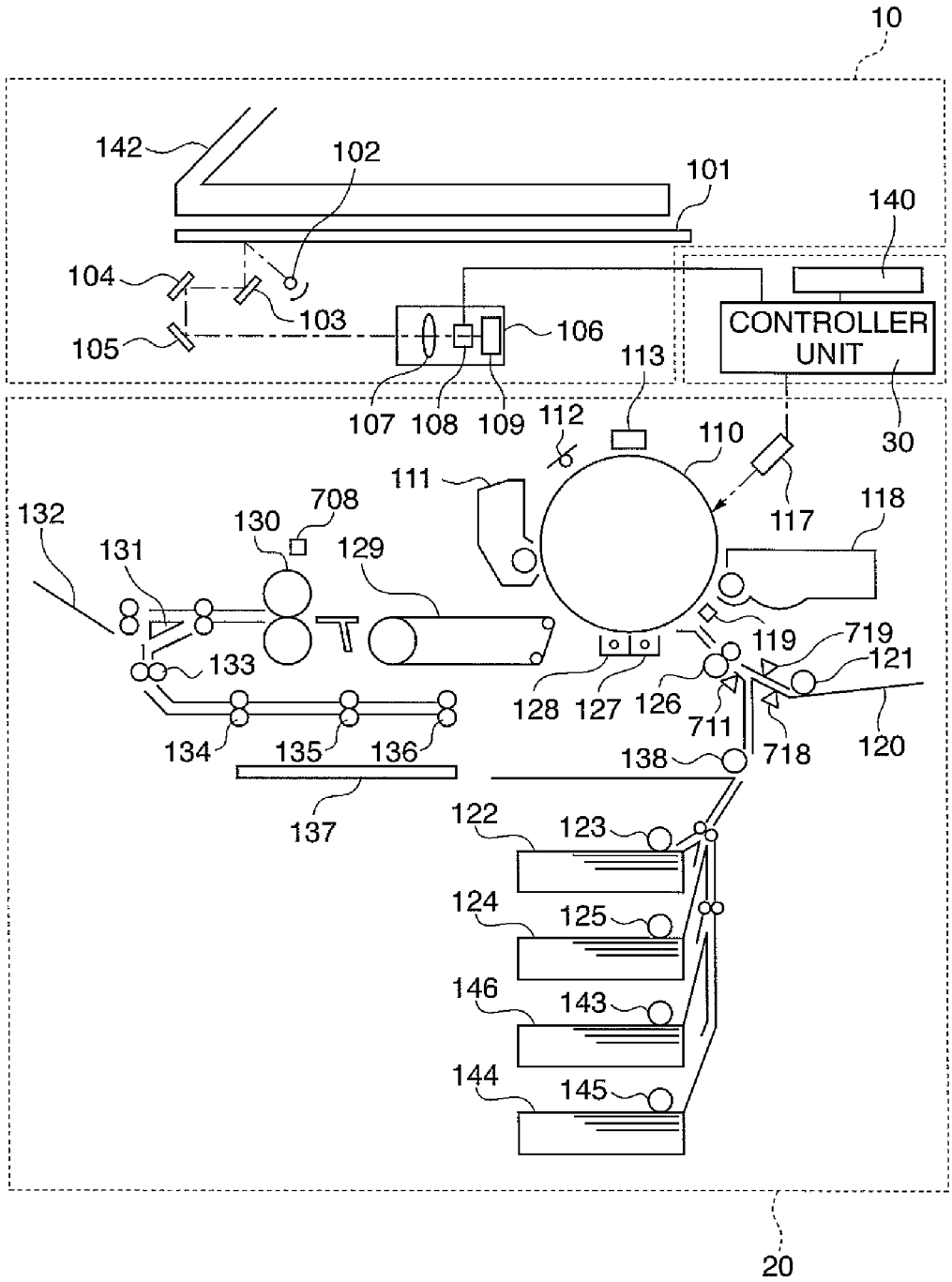
FIG. 2 is a longitudinal sectional view showing the internal construction of the multifunction peripheral 5.

FIG. 2 is a longitudinal sectional view showing the inner construction of the multifunction peripheral 5. In the scanner section 10, originals fed from the automatic original feeder (original feeder) 142 are sequentially placed at a predetermined location on an original platen glass 101. An original illumination lamp 102 is implemented by, for example, a halogen lamp and exposes an original placed on the original platen glass 101 to light. Scanning mirrors 102, 104, and 105 are housed in an optical scanning unit, not shown, and guide reflected light from an original to a CCD unit 106 while moving back and forth. The CCD unit 106 is comprised of an image pickup device (CCD) 108, an imaging lens 107 that forms an image on the image pickup device 108 from reflected light from an original, a CCD driver 109 that drives the image pickup device 108, and so forth. An image signal output from the image pickup device 108 is converted into, for example, 8-bit digital data and then input to the controller unit 30.

On the other hand, in the printer section 20, electricity is removed from a photosensitive drum 110 by a pre-exposure lamp 112 so as to prepare for image formation. A primary charger 113 uniformly charges the photosensitive drum 110. A semiconductor laser 117 as an exposure unit exposes the photosensitive drum 110 to light based on image data processed by the controller unit 30, thereby forming an electrostatic latent image. A developing unit 118 contains a black toner. A pre-transfer charger 119 applies high voltage to the photosensitive drum 110 before a toner image developed on the photosensitive drum 110 is transferred onto a sheet. From each of a manual sheet feed unit 120 and the sheet feed units 122, 124, 146, and 144, a transfer sheet is fed into the apparatus by a corresponding one of sheet feed rollers 121, 123, 125, 143, and 145 and temporarily stopped at the location where resist rollers 126 are disposed. The sheet is then fed again in synchronization with timing in which an image is formed on the photosensitive drum 110. A width detecting sensor 718 and a length detecting sensor 719 that detect the width and length, respectively, of an irregular-size recording sheet as will be described later are provided between the sheet feed roller 121 and the resist rollers 126. Similarly, a Top sensor 711 that detects the leading end of a transfer sheet being conveyed as will be described later is disposed between the sheet feed rollers 121, 123, 125, 143, and 145 and the resist rollers 126.

A transfer charger 127 transfers a toner image developed on the photosensitive drum 110 onto a transfer sheet being fed. A separation charger 128 separates the transfer sheet on which the toner image has been transferred from the photosensitive drum 110. Toner left on the photosensitive drum 110 without being transferred onto the transfer sheet is collected by a cleaner 111.

A conveying belt 129 conveys the transfer sheet onto which the toner image has been transferred to a fixing unit 130 and fixes the toner image by heating it. A flapper 131 switches the path for conveying the transfer sheet onto which the toner image has been fixed to either a path toward a sorter 132 or a path toward an intermediate tray 137. Feed rollers 133 to 136 causes the transfer sheet onto which the toner image has been fixed to be temporarily inverted on the intermediate tray 137 (multiple), or causes the same to be fed without being inverted (double-sided). A re-feed roller 138 conveys the transfer sheet placed on the intermediate tray 137 again to the resist rollers 126. The controller unit 30 includes a microcomputer and others and controls the above described image forming operation in accordance with instructions from the operating section 140.

Figure 3:
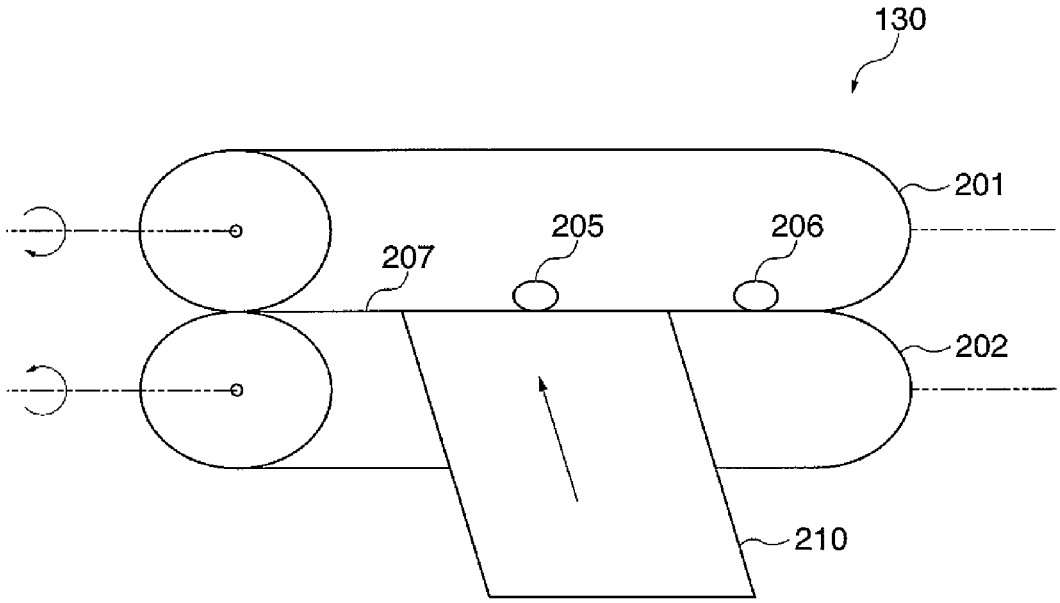
FIG. 3 is a view schematically showing the construction of a fixing unit 130.

FIG. 3 is a view schematically showing the construction of the fixing unit 130. The fixing unit 130 is comprised of a heat roller 201 that has a heater incorporated therein, and a pressurizing roller 202 that is in urging contact with the heat roller 201 so that the pressurizing roller 202 and the heat roller 20 form a nip section 207. These two rollers 201 and 202 rotate in opposite directions about parallel axes to cause a recording sheet 210 to be passed through the nip section 207. The nip section 207 is provided with a first thermistor 205 and a second thermistor 206 that control the fixing temperature to a fixing temperature required to fix toner on the recording sheet 210. The first thermistor 205 is disposed in the midsection of the nip section 207 in the axial direction thereof, and the section thermistor 206 is disposed at an end of the nip section 207 in the axial direction thereof. An ambient temperature sensor 708 that detects the ambient temperature is disposed in the vicinity of the fixing unit 130 (see FIG. 2). It should be noted that the heat roller 201 itself may be heated by electromagnetic induction (IH).

Figure 4:
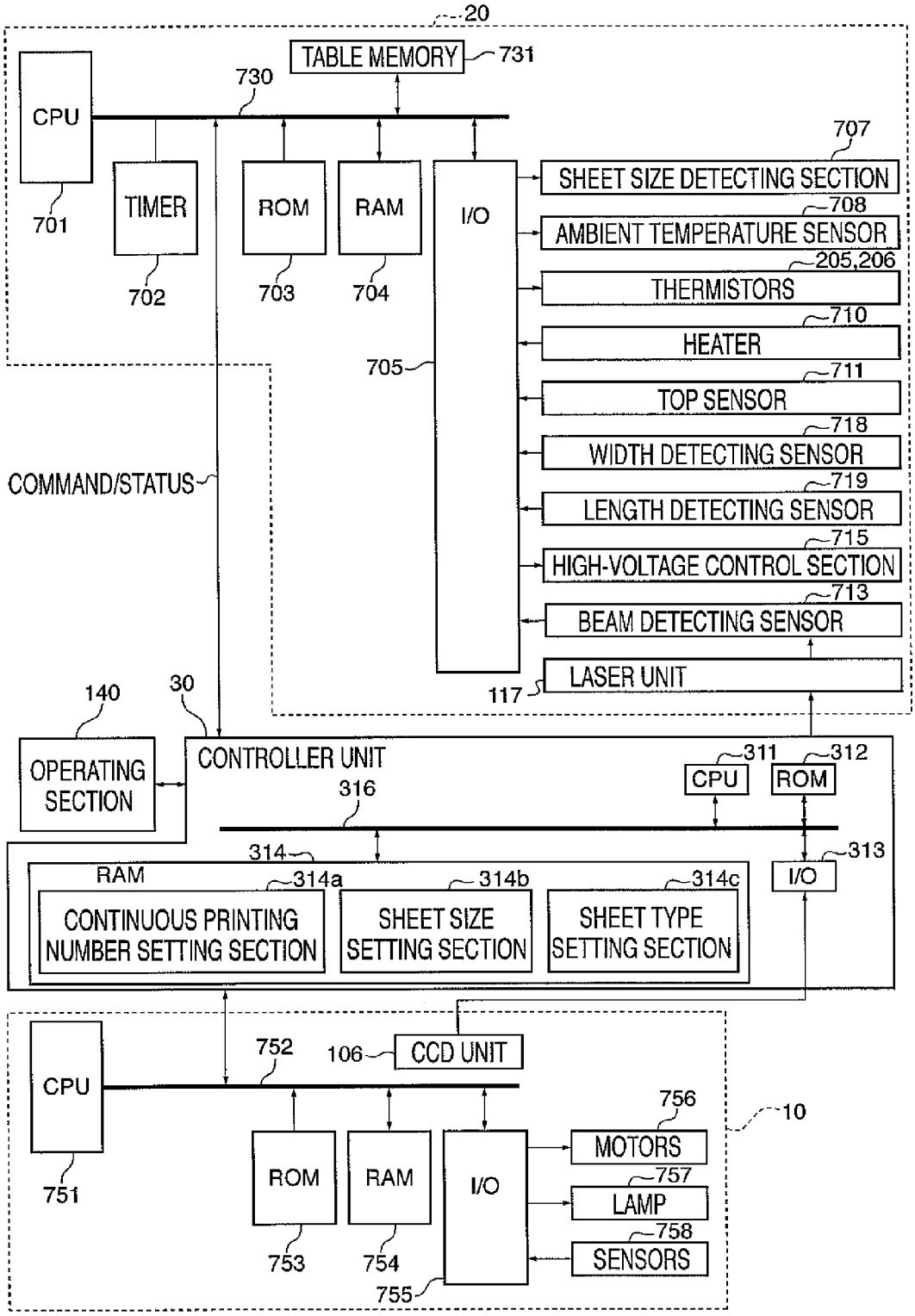
FIG. 4 is a diagram showing the constructions of a scanner section 10 and a printer section 20 in the multifunction peripheral 5.

FIG. 4 is a diagram showing the constructions of the scanner section 10 and the printer section 20 in the multifunction peripheral 5. A CPU 751 within the scanner section 10 controls the component elements of the scanner section 10 and sequentially reads and executes control programs stored in a read-only memory (ROM) 753. The ROM 753, a random-access memory (RAM) 754, an I/O interface 755, and so forth are connected to a bus 752 of the CPU 751. The bus 752 is connected to a CPU (311) within the controller unit (main controller) 30, so that the CPU 751 can communicate with the CPU within the main controller 30.

The RAM 754 is a main memory used to store input data and used as a storage area for operation. Motors 756 that drive a sheet feed system, a conveying system, and an optical system, lamps 757, and sensors 758 that detects a sheet being conveyed are connected to the I/O interface 755. Image data read by the CCD unit 106 is transferred to the controller unit 30.

On the other hand, a CPU 701 within the printer section 20 controls the component elements of the printer section 20 and sequentially reads and executes control programs stored in a read-only memory (ROM) 703. A random-access memory (RAM) 704, a timer 702, a table memory 731, an I/O interface 705, and so forth as well as the CPU 701 and the ROM 703 are connected to a bus 730 of the CPU 701. The timer 702 is used as a throughput timer, described later.

The RAM 704 is a main memory used to store input data and used as a storage area for operation. A sheet size detecting section 70 that detects the size of a sheet being conveyed (regular-size sheet) as well as motors, clutches, and solenoids, not shown, that drive a sheet feed system is connected to the I/O interface 705. An ambient temperature sensor 708 that detects the temperature of the environment surrounding the fixing unit 130, the first thermistor 205 and the second thermistor 206 disposed in the fixing unit 130, and a heater 710 incorporated in the heat roller 201 are also connected to the I/O interface 705. A Top sensor 711 that detects the leading end of a recording sheet (transfer sheet) being conveyed to the fixing unit 130, and a width detecting sensor 718 and a length detecting sensor 719 that detect the width and length, respectively, of a recording sheet (e.g. recording sheet of an irregular-size) being fed from the manual feed unit 120 are also connected to the I/O interface 705. A high-voltage unit 715, a beam detecting sensor 713, and so forth are also connected to the I/O interface 705. The high-voltage unit 715 outputs high voltage to the primary charger 113, developing unit 118, pre-transfer charger 119, transfer charger 127, and separation charger 128 in accordance with an instruction from the CPU 701.

The controller unit (main controller) 30, which is comprised of the CPU 311, a ROM 312, an I/O interface 313, etc. connected to one another via a bus 316, is capable of communicating with the scanner section 10 and the printer section 20 and inputting and outputting data to and from the operating section 140. The RAM 314 is provided with a continuous printing number setting section 314*a*, a sheet size setting section 314*b*, and a sheet type setting section 314*c* that set the continuous printing number, the recording sheet size, and the recording sheet type, respectively, through operation of the operating section 140 by an operator. The controller unit 300 performs image processing on an image signal output from the CCD unit 106 and outputs a control signal corresponding to the image data to the laser unit 117. The laser unit 117 outputs a laser beam to illuminate the photosensitive drum 110 and exposes the same to light. When the beam detecting sensor 713 as a light receiving sensor provided in a non-image area detects the light-emitting state of the photosensitive drum 110, an output signal from the beam detecting sensor 714 is input to the I/O interface 705.

FIG. 5 is a table showing the optimum throughput with respect to each recording sheet size and each number of prints to be continuously produced. This throughput table is stored in a table memory 731 provided within an engine controller. This throughput table exhibits the optimum (fastest) throughput with respect to each continuous printing number in the case where the recording sheet size is any of LTR-R, A4-R, and LGL. Specifically, in the case where the recording sheet size is LTR-R, the throughput is 20 ppm when the continuous printing number is 1 to 20; 18 ppm, 21 to 40; 16 ppm, 41 to 60; 14 ppm, 61 to 80; and 12 ppm, 81 to 99. In the case where the recording sheet size is A4-R, the throughput is 18 ppm when the continuous printing number is 1 to 20; 16 ppm, 21 to 40; 14 ppm, 41 to 60; 12 ppm, 61 to 80; and 10 ppm, 81 to 99. In the case where the recording sheet size is LGL, the throughput is 16 ppm when the continuous printing number is 1 to 20; 14 ppm, 21 to 40; 12 ppm, 41 to 60; 10 ppm, 61 to 80; and 9 ppm, 81 to 99. These throughput settings will be described later.

Figure 6:
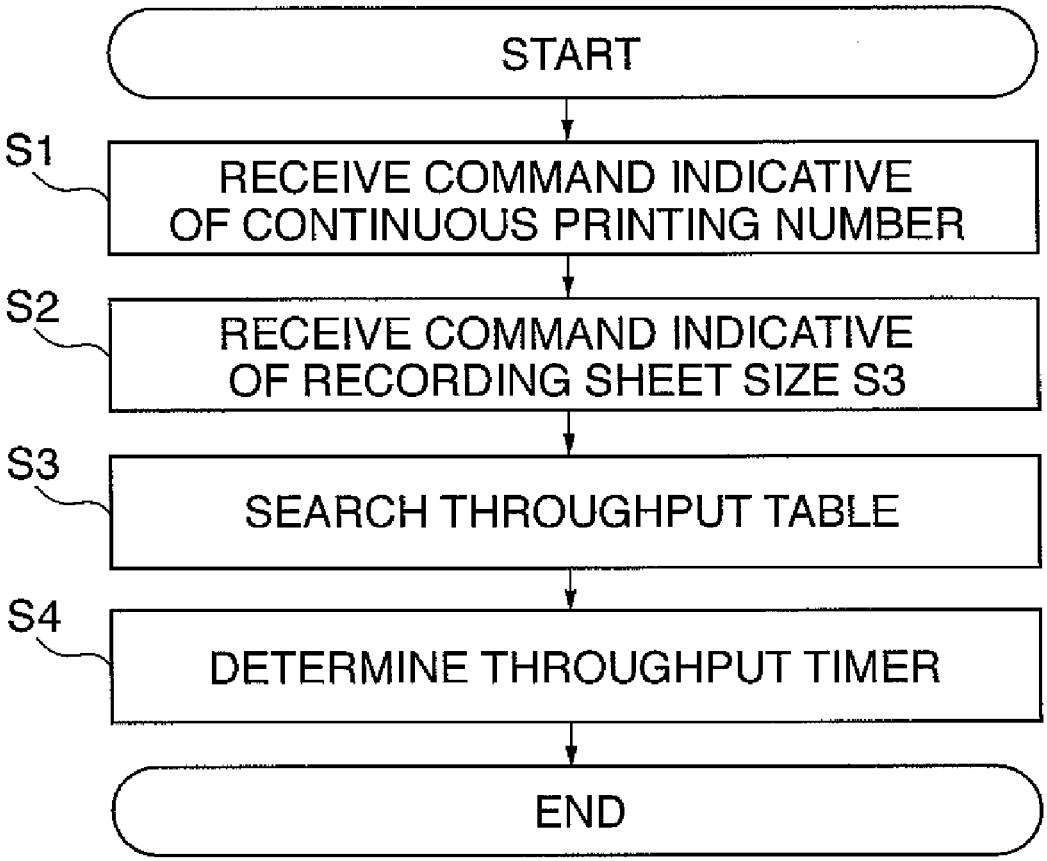
FIG. 6 is a flowchart showing the procedure of a throughput timer determining process in conveying a recording sheet.

A description will now be given of how a recording sheet is conveyed in the multifunction peripheral 5 constructed as described above. FIG. 6 is a flowchart showing the procedure of a throughput timer determining process in conveying a recording sheet. A processing program for implementing this process is stored in the ROM 703 within the engine controller and executed by the CPU 701. The number of prints to be continuously produced and the sheet size set through the operation of the operating unit 140 by the operator are stored in advance in the number of continuously produced prints setting section 314*a* and the sheet size setting section 314*b*, respectively.

First, a command indicative of the continuous printing number and a command indicative of the recording sheet size are received from the controller unit (main controller) 30 (steps S1 and S2). It is assumed here that the engine controller receives the recording sheet size set through operation of the operating section 140 by the user (operator) from the main controller 30. It goes without saying that in the case where the multifunction peripheral has a function of detecting the recording sheet size, the recording sheet size thus detected may be used without using the recording sheet size set by the user.

FIGS. 7A and 7B are views showing the command indicative of a continuous printing number and the command indicative of the recording sheet size received in the step S1 and the step S2, respectively. FIG. 7A shows the command indicative of the continuous printing number, and FIG. 7B shows the command indicative of the recording sheet size. These commands are each comprised of 16 bits. A bit group consisting of the first to seventh bits expresses the type of command (i.e. command indicative of the continuous printing number or command indicative of the recording sheet size). A bit group consisting of the subsequent bits expresses variable information (the continuous printing number or the recording sheet size).

After the command indicative of the continuous printing number and the command indicative of the recording sheet size are received, the throughput table (see FIG. 5) is searched based on the continuous printing number and the recording sheet size (step S3). As a result of the search, a corresponding throughput is regarded as the optimum throughput, and a Top-top time which is the inverse number of the optimum throughput is determined as a timer value to be set in the throughput timer (timer 702) (step S4), followed by terminating the process.

Figures 8A, 8B:
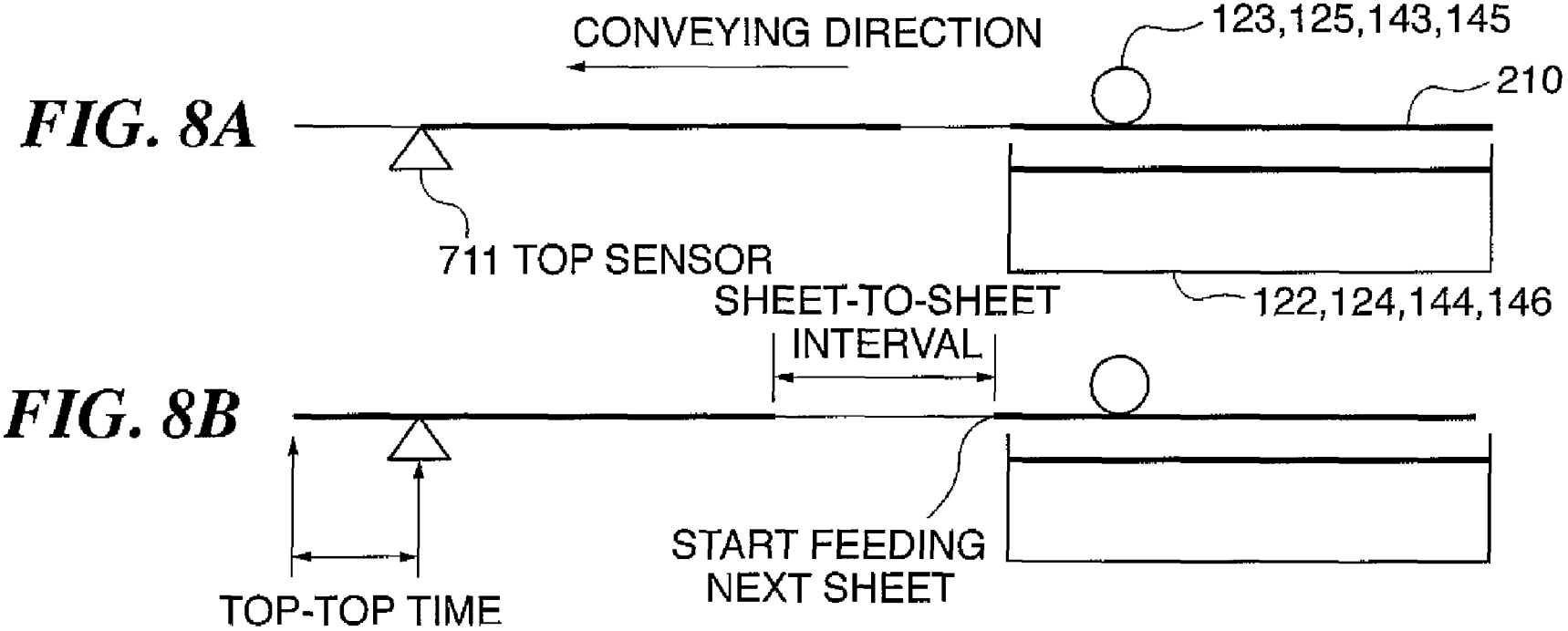
FIGS. 8A and 8B are diagrams showing a state in which the leading end of a recording sheet fed by sheet feed rollers is detected by a Top sensor 711.

A description will now be given of how recording sheets are conveyed with a sheet-to-sheet interval formed therebetween using the Top-top time determined as described above. FIGS. 8A and 8B are views showing a state in which the leading end of a recording sheet fed by the sheet feed rollers is detected by the Top sensor 711. FIG. 8A shows a state in which the leading end of the recording sheet 210 reaches the Top sensor 711, and FIG. 8B shows a state in which the Top-top time has elapsed since the fed recording sheet 210 reached the Top sensor 711. When the Top-top time has elapsed since the fed recording sheet 210 reached the Top sensor 711, the next recording sheet 210 is fed from a cassette. The distance between the trailing end of the recording sheet fed earlier than the next recording sheet and the leading end of the recording sheet 210 fed next is the sheet-to-sheet interval. When the Top-top time is changed, the sheet-to-sheet interval is also changed.

Figure 9:
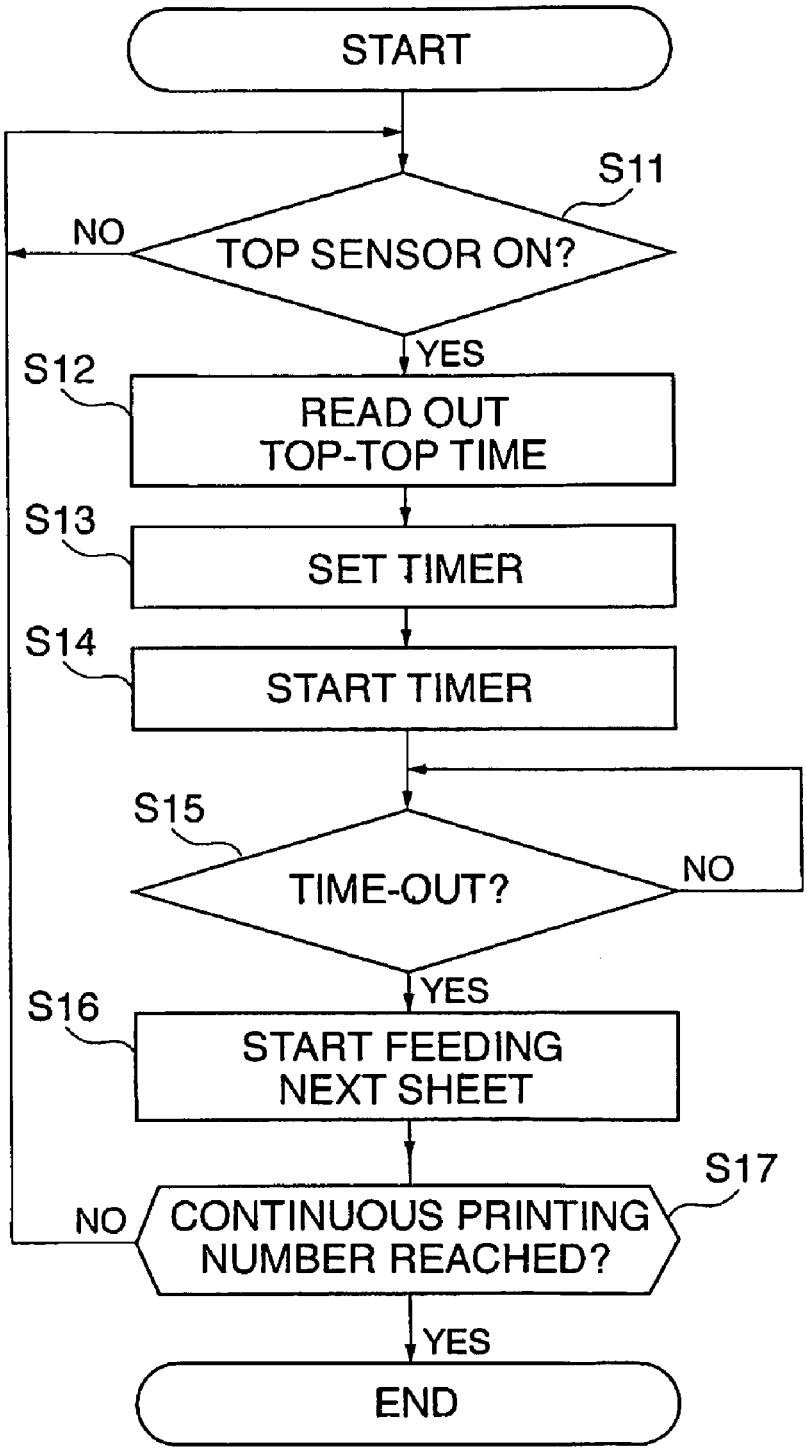
FIG. 9 is a flowchart showing the procedure of a sheet feeding process.

FIG. 9 is a flowchart showing the procedure of a sheet feeding process. A processing program for implementing this process is stored in the ROM 703 within the engine controller and executed by the CPU 701. First, it is awaited that the leading end of a fed recording sheet reaches the Top sensor 711 (step S11). When the leading end of the fed recording sheet reaches the Top sensor 711, a corresponding throughput is read out from the throughput table (see FIG. 5), and the Top-top time which is the inverse number of the throughput is obtained (step S12). In the present embodiment, the Top-top time is based on the continuous printing number and the recording sheet size. The readout Top-top time is set in the timer 702 (step S13). The timer 702 is then started (step S14), and time-out is awaited (step S15). Upon time-out, feeding of the next recording sheet 210 is started (step S16). It is then determined whether or not the number of prints has reached the continuous printing number (step S17). If the determination result is negative, the process returns to the step S11, and if affirmative, the process is terminated.

Figure 10:
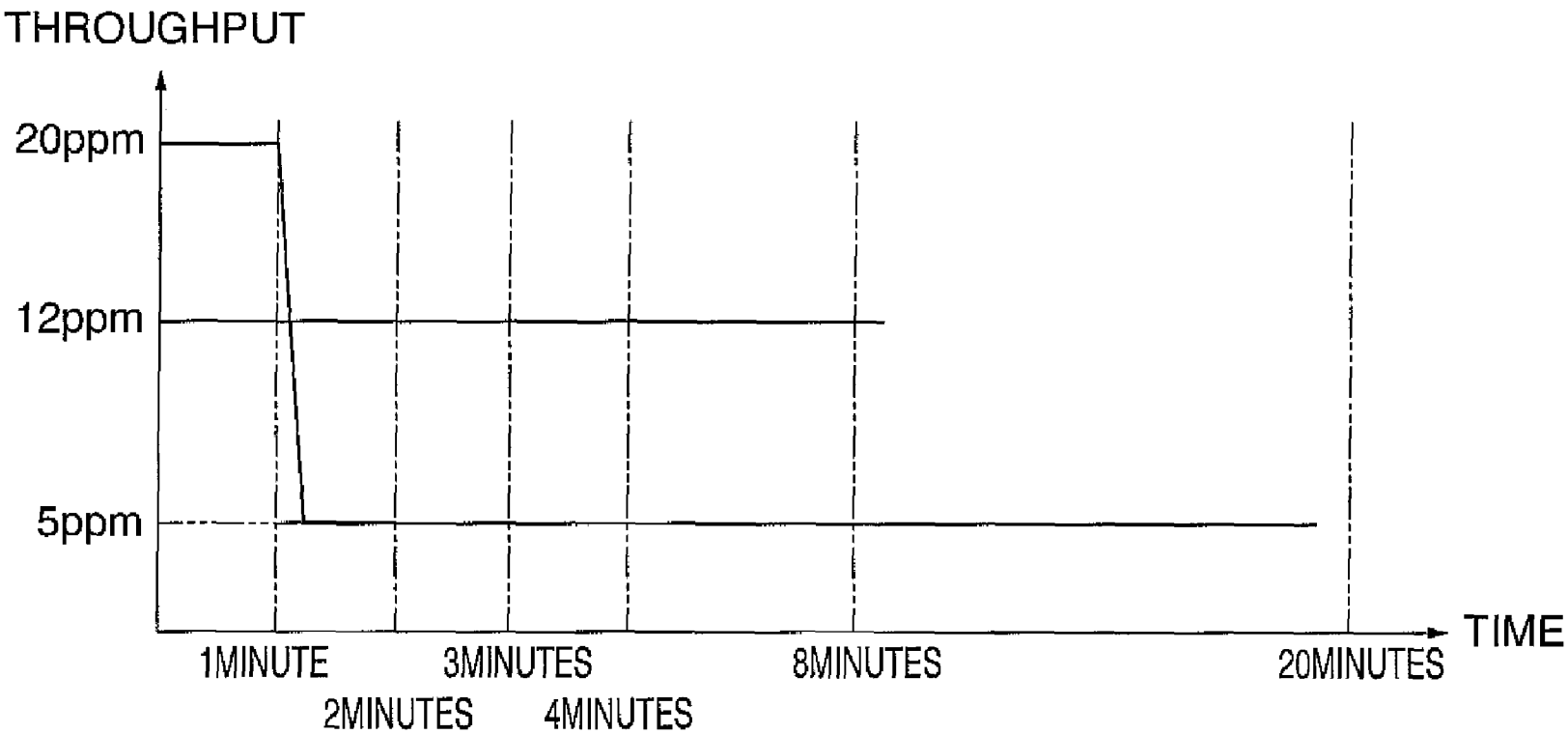
FIG. 10 is a graph showing the times required to complete printing at different throughputs.

For example, assuming that 99 prints are to be continuously produced on recording sheets of the size LTR-R, the times required to complete printing in the case where printing is started at 22 ppm and at 12 ppm are as follows. FIG. 10 is a graph showing the times required to complete printing at different throughputs. When the throughput is 20 ppm, the time required to complete printing is almost 20 minutes, and when 12 ppm, almost 8 minutes.

As described above, the multifunction peripheral according to the first embodiment makes it possible to perform the fastest printing suitable for the continuous printing number and the recording sheet size in performing continuous printing. That is, the fastest printing can be realized with respect to each number of prints to be continuously produced while a temperature increase at the ends of the rollers constituting the fixing unit is prevented.

Figure 11:
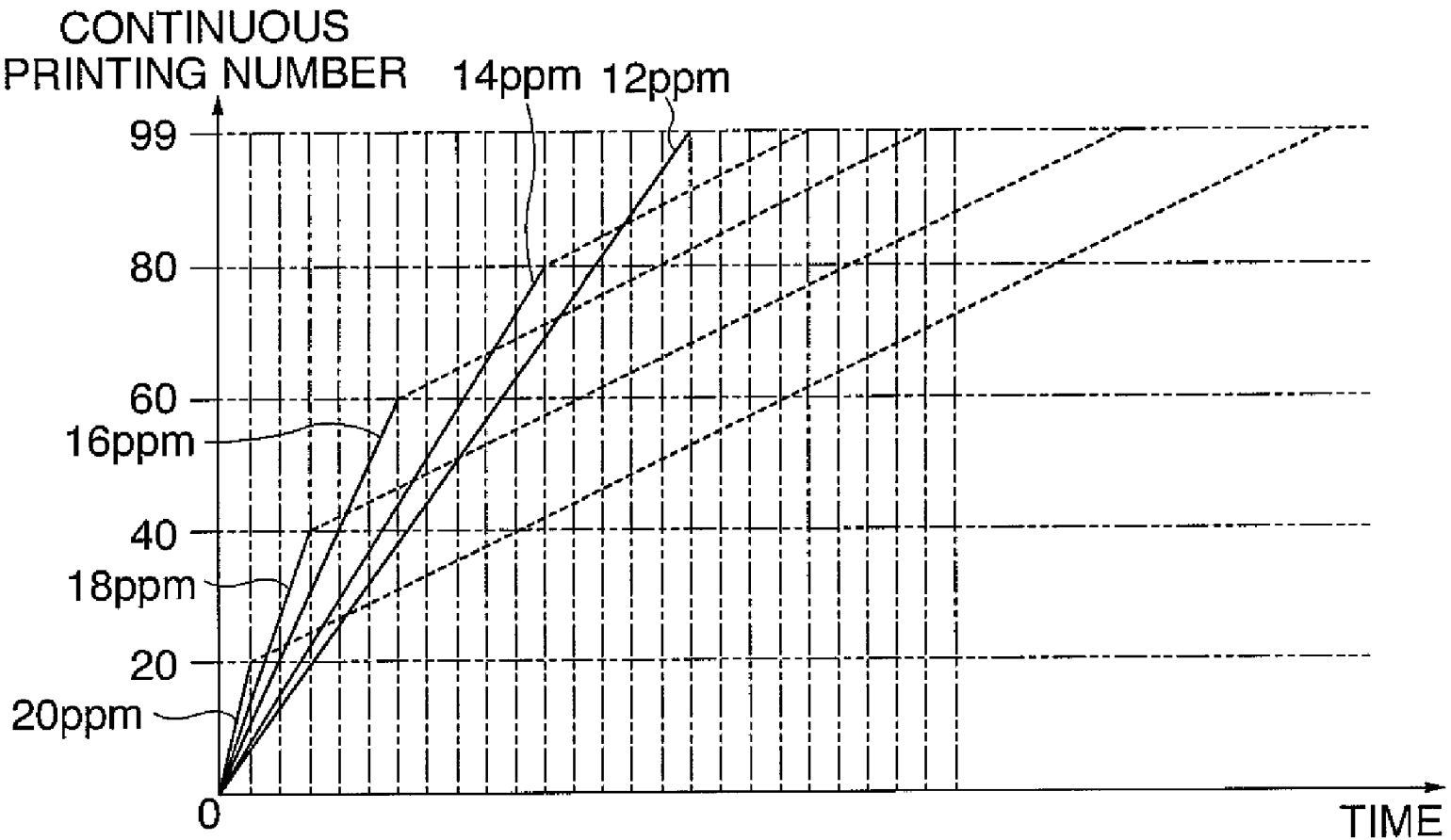
FIG. 11 is a graph showing the continuous printing number with respect to each throughput in the case where the recording sheet size is LTR-R.
Figure 12:
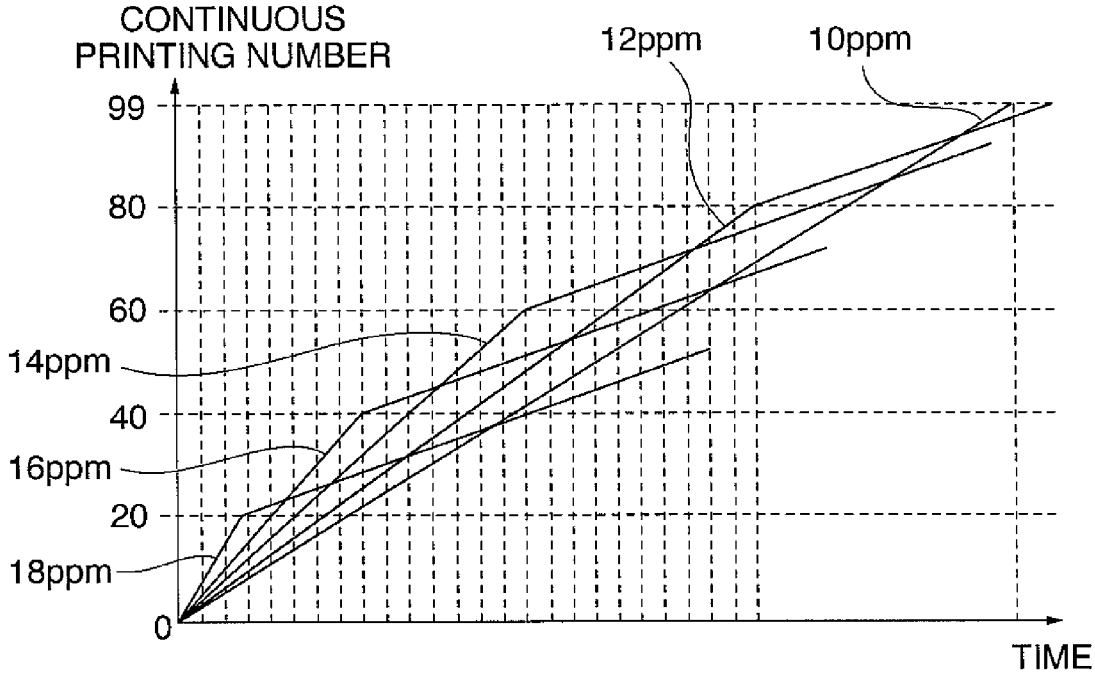
FIG. 12 is a graph showing the continuous printing number with respect to each throughput in the case where the recording sheet size is A4-R.

Here, consider the throughput settings in the throughput table in FIG. 5. First, consider that the time at which the temperature at the ends of the rollers (hereinafter referred to as "the end temperature") reaches the upper limit varies with throughputs as described above. Specifically, the time it takes for the end temperature to reach the upper limit increases as the throughput decreases to 20 ppm, 18 ppm, and 16 ppm. The same goes for the case where the continuous printing number exhibited until the end temperature reaches the upper limit increases as the throughput decreases. This means that there is the optimum throughput for the continuous printing number. FIG. 11 is a graph showing the continuous printing number with respect to each throughput in the case where the recording sheet size is LTR-R. When the recording sheet size is LTR-R, the highest throughput is 20 ppm with respect to the continuous printing number 1 to 20; 18 ppm, 21 to 40; 16 ppm, 41 to 60; 14 ppm, 61 to 80; and 12 ppm, 81 to 99. FIG. 12 is a graph showing the continuous printing number with respect to each throughput in the case where the recording sheet size is A4-R. When the recording sheet size is A4-R, the fastest throughput is 18 ppm with respect to the continuous printing number 1 to 20; 16 ppm, 21 to 40; 14 ppm, 41 to 60; 12 ppm, 61 to 80; and 10 ppm, for 81 to 99. In this manner, by properly setting the throughput according to the continuous printing number, the time required to complete printing can be minimized with respect to each continuous printing number.

Secondly, consider that the degree of increase in end temperature in the fixing unit is influenced by the width of a recording sheet passing through the nip section of the fixing unit as described above. The greater the width of a recording sheet, the wider the area of the rollers from which heat is drawn by the recording sheet in the axial direction, and therefore, the greater the amount of heat that leaves the ends, which will cause a decrease in end temperature. As described above, according to Japanese Laid-Open Patent Publication (Kokai) No. H01-149081, the interval between narrow recording sheets is set to be long so as to suppress the rise in the temperature at the rollers' ends.

On the other hand, the degree of increase in end temperature in the fixing unit is also influenced by the time it takes for a recording sheet to pass through the nip section of the fixing unit. The longer it takes for a recording sheet to pass through the nip section, the more the amount of heat in the midsection of the rollers is drawn by the recording sheet, and the greater the amount of heat generated by the heater. Also, the temperature at the ends of the rollers from which heat is not drawn by the recording sheet continuously increases. The time it takes for a recording sheet to pass through the nip section in continuous printing is determined by the length of the recording sheet and the sheet-to-sheet interval on average, and the degree of increase in end temperature is determined by the ratio of the sheet length to the sheet-to-sheet interval.

Figure 13:
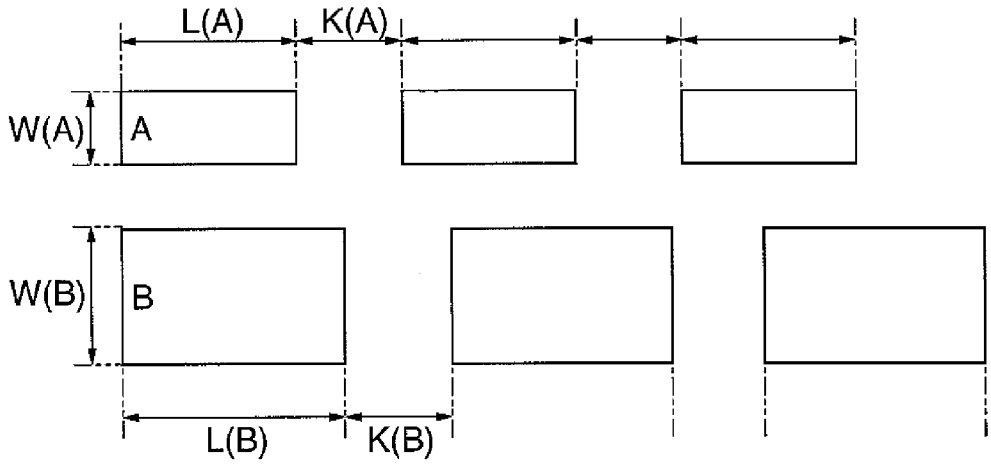
FIG. 13 is a view showing sheet-to-sheet intervals in continuous printing on recording sheets A and B.

Accordingly, the degree of increase in end temperature is inversely proportional to the width of a recording sheet and proportional to the ratio of the sheet length to the sheet-to-sheet interval. FIG. 13 is a view showing the sheet-to-sheet intervals in continuous printing on recording sheets A and B. Here, the width, length, and sheet-to-sheet interval of recording sheets are designated by W, L, and K, respectively. The relationship in width, length, and sheet-to-sheet interval between two recording sheets A and B is represented by the following mathematical expressions (1):

$$W(A)<W(B),\ L(A)<L(B),\ K(A)=K(B) \quad (1)$$

Figure 14:
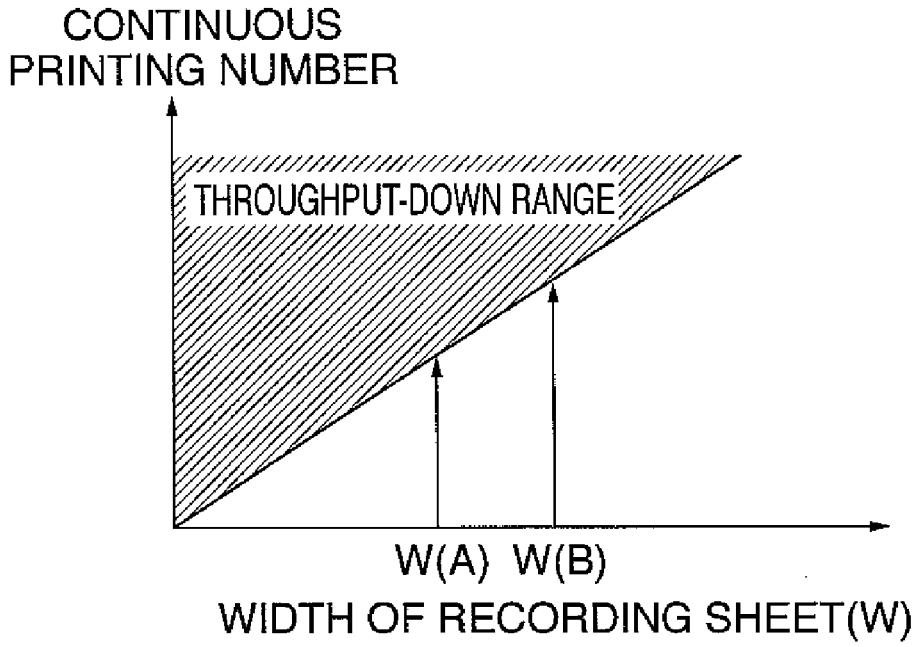
FIG. 14 is a view showing a throughput-down range with respect to the recording sheet width W.

Considering only the recording sheet width W, the number of prints produced before a throughput decrease occurs (i.e. the maximum number of prints that can be continuously produced) is larger for the recording sheets B than for the recording sheets A as described above. A range equal to or greater than the maximum continuous printing number is referred to as a throughput-down range. FIG. 14 is a view showing the throughput-down range with respect to the recording sheet width W.

Figure 15:
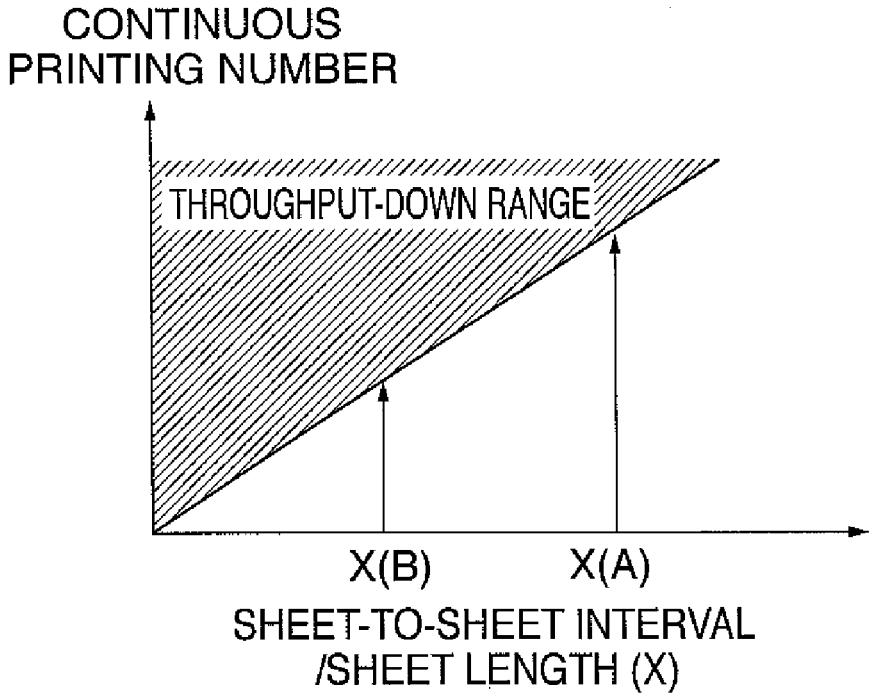
FIG. 15 is a view showing a throughput-down range with respect to the ratio X of the recording sheet length L to the sheet-to-sheet interval K.

On the other hand, considering the recording sheet length L, the degree of increase in end temperature is smaller at a higher ratio X of the recording sheet length L to the sheet-to-sheet interval K since the heat at the ends can be more easily shifted to the midsection. Here, since X=K/L and X(A)>X(B), the number of prints produced before which a throughput decrease occurs continuous printing (i.e. the maximum number of prints that can be continuously produced) is larger for the narrower recording sheets A. FIG. 15 is a view showing a throughput-down range with respect to the ratio X of the recording sheet length L to the sheet-to-sheet interval K.

Figure 16:
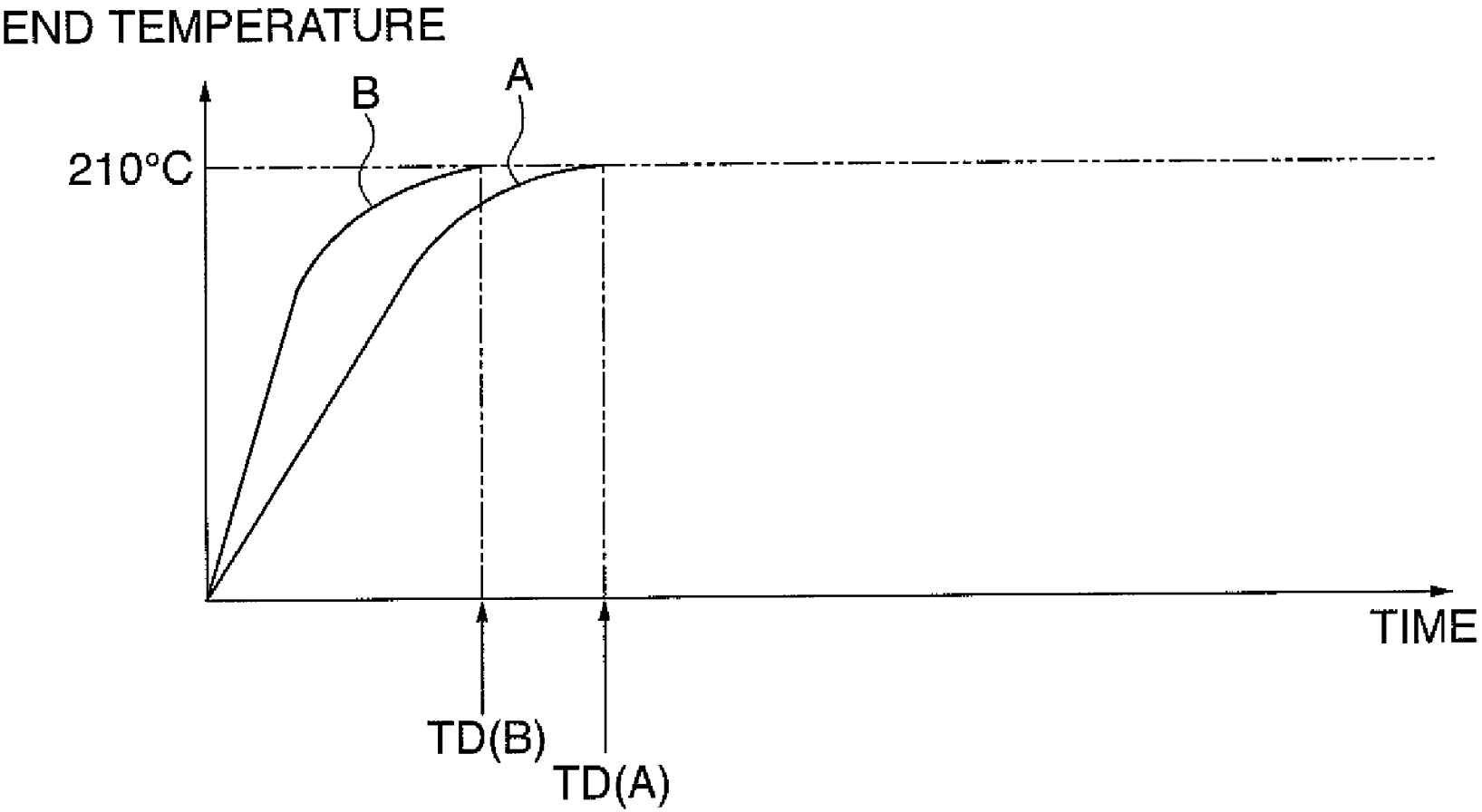
FIG. 16 is a graph showing time changes in end temperature.

This means that the optimum throughput cannot be set depending merely on the recording sheet width W. FIG. 16 is a graph showing time changes in end temperature. Assuming that the sheet-to-sheet interval is set as follows, K(A)=K(B), if narrower recording sheets A are used, the degree of increase in end temperature is smaller and the time it takes for the end temperature to reach the upper limit is TD(A), and on the other hand, if the wider recording sheets B are used, the time it takes for the end temperature to reach the upper limit is TD(B), which is shorter than the time TD(A).

Figure 17:
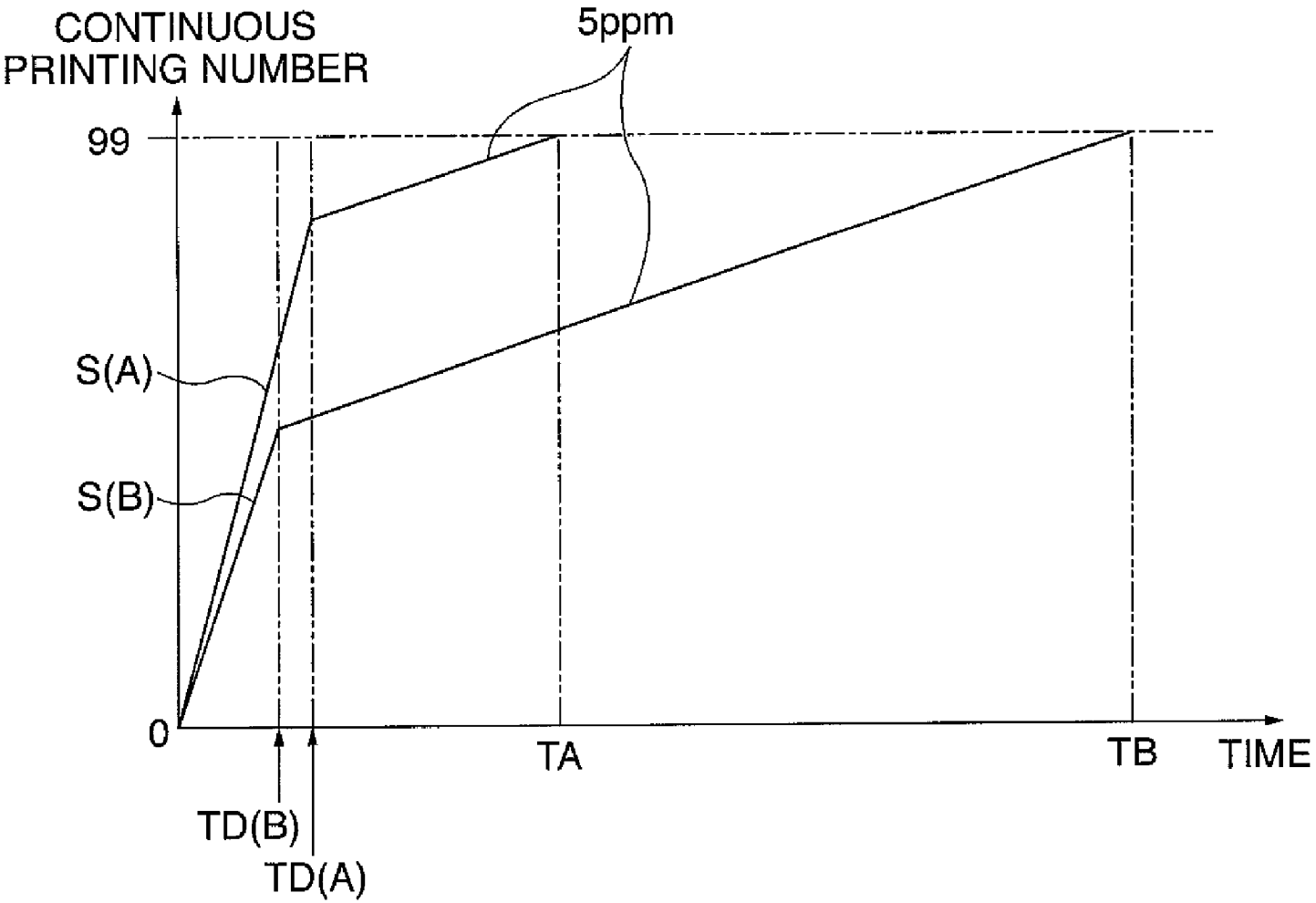
FIG. 17 is graph showing the time required to continuously produce 99 prints.

FIG. 17 is graph showing the time required to continuously produce 99 prints. The slope of a graph S(A) represents the throughput at the start of conveyance of recording sheets A. The slope of a graph S(B) represents the throughput at the start of conveyance of recording sheets B. The throughput of both the recording sheets A and B after it is decreased is 5 ppm. Since the recording sheets B are longer than the recording sheets A and have the same sheet-to-sheet interval as that of the recording sheets A, it is obvious that the throughput represented by the graph S(A) is higher than the throughput represented by the graph S(A). On the other hand, as described earlier, the throughput of the recording sheets A is decreased at a time later than that of the recording sheets B. Thus, the graphs S(A) and S(B) have the relationship as illustrated.

For example, assuming that the number of prints produced before a throughput decrease is 80 in the case where the recording sheets A are used, the throughput of the recording sheets B is further decreased and their sheet-to-sheet interval is further widened until 80 prints are produced. That is, even though the recording sheets A are narrower than the recording sheets B, the recording sheets A have a shorter sheet-to-sheet interval than the recording sheets B as distinct from the conventional art disclosed in Japanese Laid-Open Patent Publication (Kokai) No. H01-149081. Thus, the throughput values in the throughput table in FIG. 5 are set with consideration given to the first and second factors described above.

Although in the above described embodiment, the throughput table that exhibits the optimum throughput with respect to each number of prints to be continuously produced and each recording sheet size (see FIG. 5) is used, a throughput table that is set with consideration given to the ambient temperature may be used. FIG. 18 is a table showing the optimum throughput with respect to each recording sheet size of regular-size sheet and each number of prints to be continuously produced in the case where the ambient temperature is taken into consideration. If the ambient temperature is high, a small throughput value is set since the temperature at the ends of the rollers increase due to the high ambient temperature, even with the recording sheet size and the continuous printing number being the same. Here, the ambient temperature is directly detected by the ambient temperature sensor 708 disposed in the vicinity of the fixing unit. The optimum throughput determined with consideration given to the ambient temperature is retrieved from the throughput table (see FIG. 18) in the above described step S3 in FIG. 6.

In a multifunction peripheral according to a second embodiment of the present invention, the recording sheet type (e.g. thick sheet, thin sheet, and OHP sheet) as well as the recording sheet size, the continuous printing number, and the ambient temperature are taken into consideration in determining the optimum throughput. It should be noted that the construction of the multifunction peripheral according to the second embodiment is the same as that of the multifunction peripheral according to the above described first embodiment, and therefore description thereof is omitted.

FIG. 19 is a view showing a sheet type command according to the second embodiment. As is the case with the above described first embodiment, the sheet type command is transmitted from the main controller 30 to the engine controller and have the same structure as a recording sheet size command. That is, the sheet type command is comprised of 16 bits, in which a bit group consisting of the first to seventh bits indicates that the type of command, and the subsequent bits represent the sheet type.

FIG. 20 is a table showing throughputs, which is stored in the table memory 731 within the engine controller. Here, the throughput table exhibits Top-top times (Top-top times 1 to 31) which are the inverse numbers of the optimum (highest) throughputs with respect to the respective continuous printing numbers in the case where recording sheets are thick sheets, the case where recording sheets are plain sheets, the case where the recording sheet size is LTR-R, the case where the recording sheet size is A4-R, the case where the ambient temperature is less than 15° C., and the case where the ambient temperature is not less than 15° C. Since the proper fixing temperature varies with sheet types, the optimum throughput also varies with sheet types. It should be noted that although in this example, the throughput table exhibits throughputs in the case where recording sheets are thick sheets and plain sheets, throughputs may be similarly registered with respect to other sheet types such as thin sheets and OHP sheets.

Figure 21:
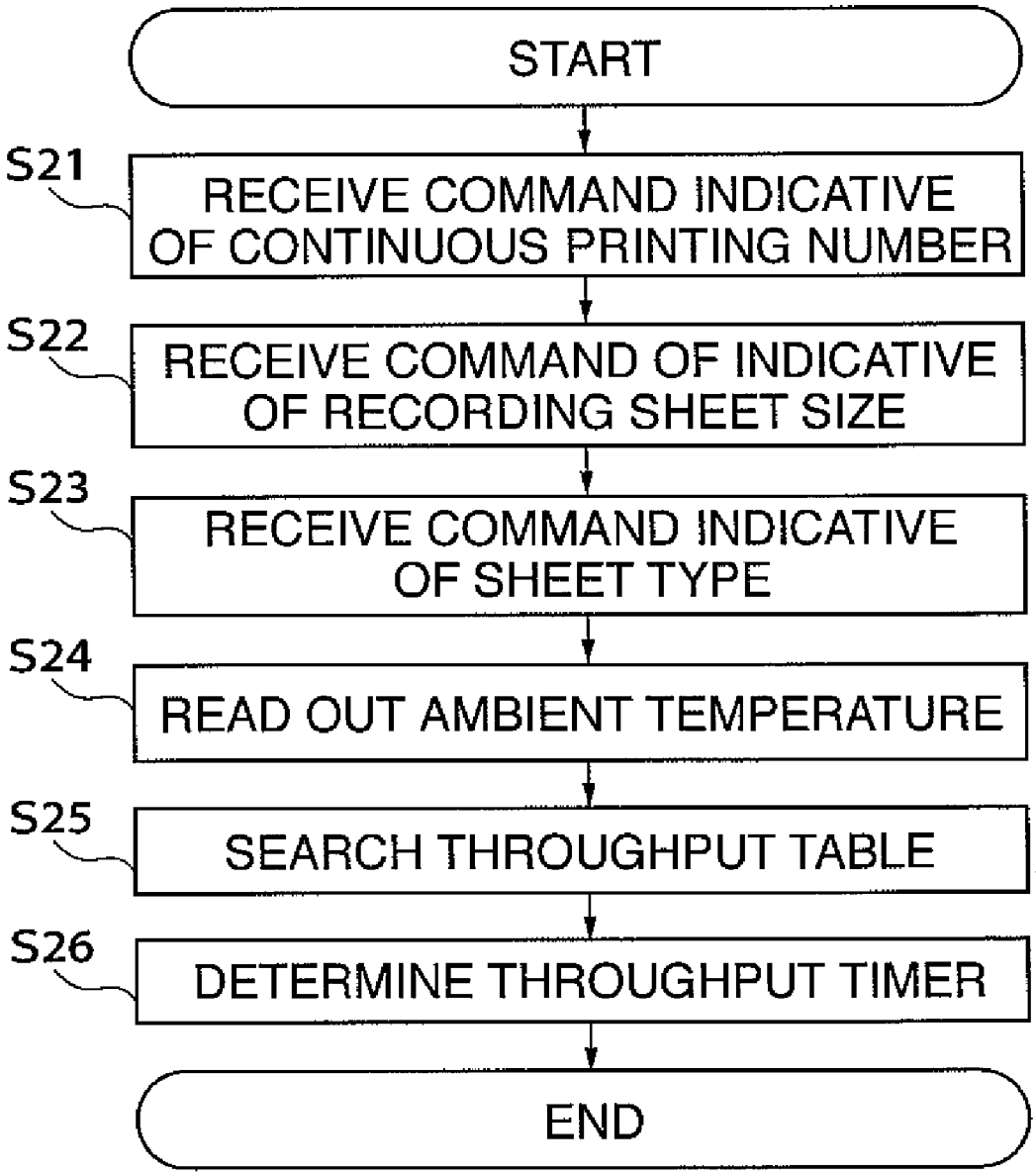
FIG. 21 is a flowchart showing the procedure of a throughput timer determining process in conveying a recording sheet.

A description will now be given of how a recording sheet is conveyed in the multifunction peripheral 5 according to the second embodiment constructed as described above. FIG. 21 is a flowchart showing the procedure of a throughput timer determining process in conveying a recording sheet. A processing program for implementing the process is stored in the ROM 7 within the engine controller and executed by the CPU 701. The number of prints to be continuously produced and the sheet size set through the operation of the operating unit 140 by an operator are stored in advance in the number-of-continuous print setting section 314*a* and the sheet size setting section 314*b*, respectively, within the ROM 314 of the main controller 30.

First, as in the steps S1 and S2 of the first embodiment described above, a command indicative of the continuous printing number and a command indicative of the recording sheet size are received from the controller unit (main controller) 30 (steps S21 and S22). Further, a command indicative of the sheet type is received (step S23). The ambient temperature around the fixing unit 130 is read by the ambient temperature sensor 708 (step S24).

The throughput table (see FIG. 20) is searched based on information on the received commands indicative of the continuous printing number, recording sheet size, and sheet type and the read ambient temperature (step S25). As a result of the search, a corresponding Top-top time which is a timer value to be set in the throughput timer is determined (step S25), followed by terminating the process. It should be noted that conveyance of recording sheets at sheet-to-sheet intervals formed using the determined Top-top time is carried out in the same manner as in the first embodiment described above.

As described above, according to the multifunction peripheral of the second embodiment, the optimum throughput can be determined in accordance with the type of recording sheet.

In the first and second embodiments described above, it is assumed that regular-size sheets of which size (width and length) is known in advance are conveyed. In general, multifunction peripherals have a function of feeding recording sheets from a manual feed unit. An operator does not always place regular-size sheets on the manual feed unit. The throughput timer values (Top-top time) of regular-size sheets are stored in advance in a memory, but there are no throughput timer values corresponding to irregular-size sheets. Accordingly, in a third embodiment of the present invention, there is proposed a method which can realize the optimum throughput even in the case where irregular-size recording sheets are conveyed. It should be noted that the construction of the multifunction peripheral according to the second embodiment is the same as that of the multifunction peripheral according to the above described first and second embodiments, and therefore description thereof is omitted.

Figure 22:
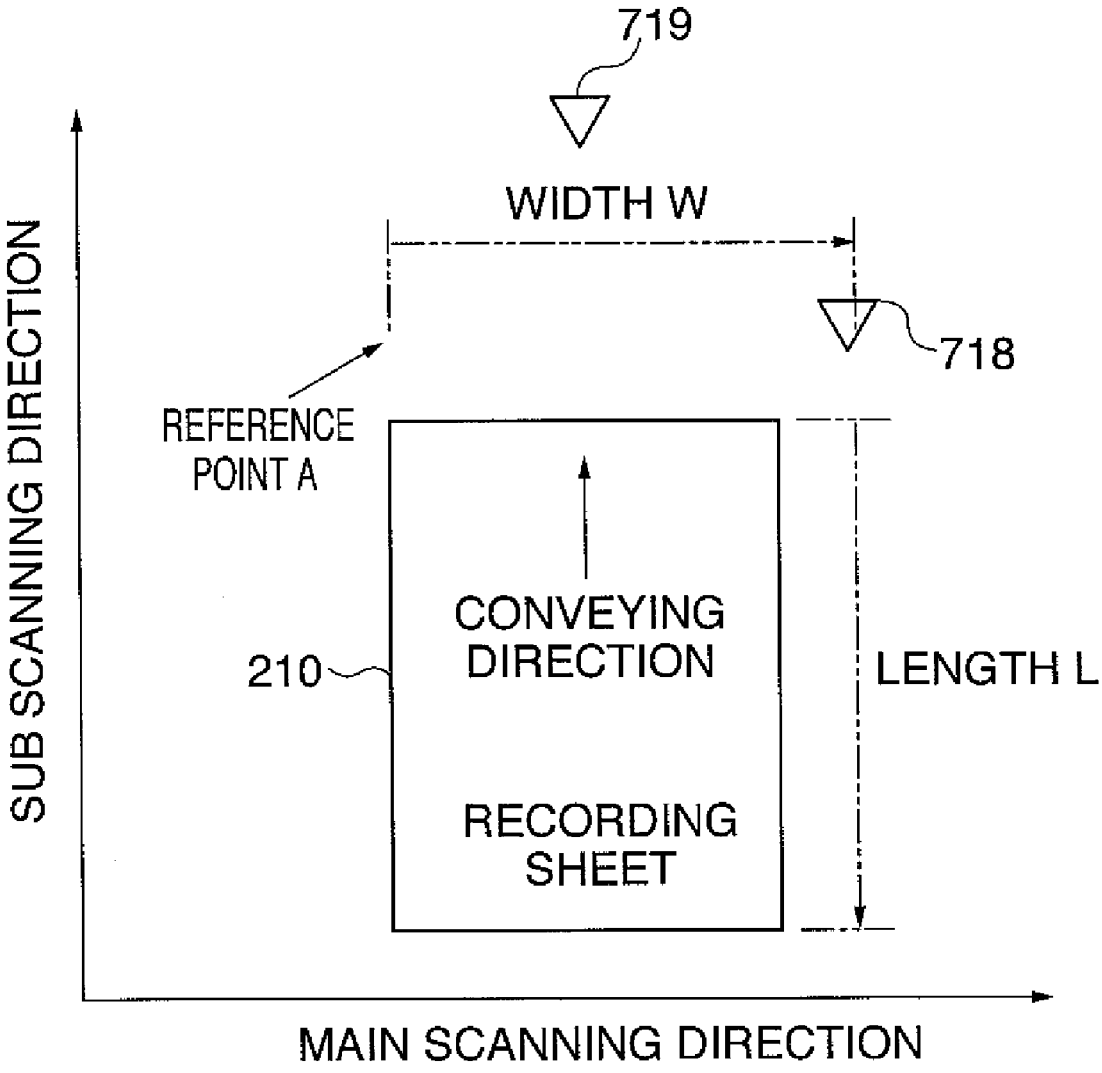
FIG. 22 is a view showing how the size of a recording sheet being conveyed is detected according to a third embodiment of the present invention.

FIG. 22 is a view showing how the size of a recording sheet being conveyed is detected according to the third embodiment. In a direction orthogonal to the direction in which recording sheets are conveyed, the width detecting sensor 718 (FIG. 1) that detects the width of a recording sheet is disposed at a distance of a width W from a reference point A. On a conveying path through which recording sheets pass, the length detecting sensor 719 (FIG. 1) that detects the length of a recording sheet is disposed.

Although depending on the width of recording sheets, there may be cases where the width detecting sensor 718 does not detect recording sheets, the length detecting sensor 719 is disposed at such a location as to detect all the recording sheets. When the width detecting sensor 718 detects a recording sheet being conveyed, this means that the recording sheet has a width not less than the width W. Also, the length of a recording sheet being conveyed is detected by measuring the time elapsed since the leading end of the recording sheet reaches the length detecting sensor 719 and until the trailing end of the recording sheet leaves the length detecting sensor 719. It should be noted that the above described Top sensor may double as the length detecting sensor.

A recording sheet size of a regular-size sheet closest to the recording sheet size (width and length) of the irregular-size sheet detected in the above described manner is selected, and a throughput timer value (Top-top time) corresponding to the selected regular-size sheet is read from the throughput table (see FIGS. 5 and 20). The second and subsequent recording sheets are fed using the read throughput timer value in the same manner as in the first and second embodiments described above, realizing the optimum throughput.

Figure 23:
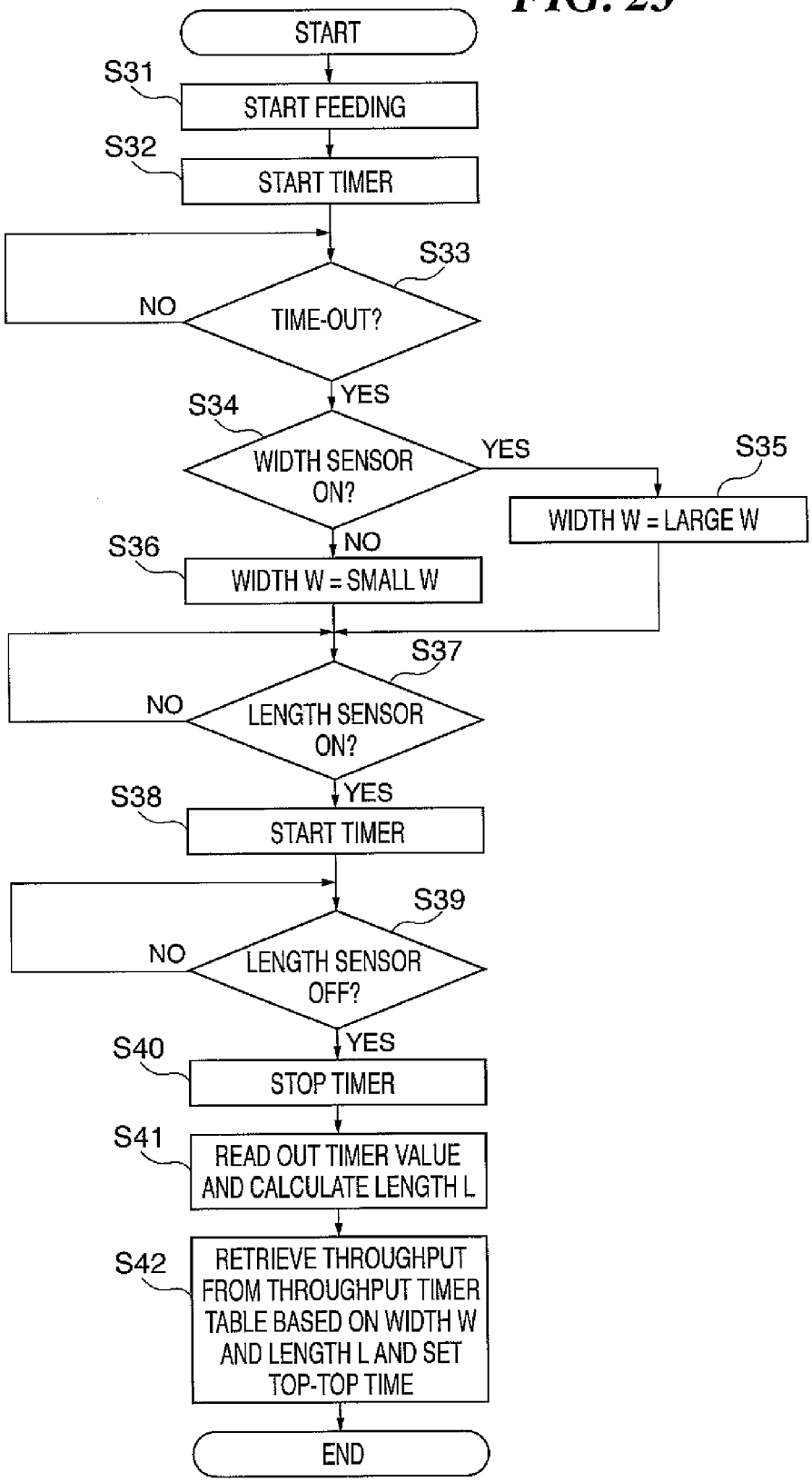
FIG. 23 is a flowchart showing the procedure of an irregular-size recording sheet size detecting process.

FIG. 23 is a flowchart showing the procedure of an irregular-size recording sheet size detecting process. A processing program for implementing the process is stored in the ROM 703 within the engine controller and executed by the CPU 701. First, feeding of a recording sheet is started (step S31), and the timer 702 for measuring the time it takes to convey the recording sheet to the location at which the width detecting sensor 718 is disposed is started (step S33). Time-out is then awaited (step S33). Upon time-out, it is determined whether or not the width detecting sensor 718 has detected the recording sheet (step S34).

If the width detecting sensor 718 has detected the recording sheet, a value LargeW not less than a predetermined value is set as the width W (step S35). On the other hand, if the width detecting sensor 718 has detected the recording sheet, a value SmallW less than a predetermined value is set as the width W (step S36). For example, the predetermined value is set to "210", the value LargeW to "220", and the value SmallW to "200." In this case, the predetermined value corresponds to the width of the A4-size. Also, these values are determined in accordance with the actual location at which the width-detecting sensor is disposed in the apparatus.

It is then awaited that the leading end of the recording sheet reaches the length detecting sensor 719 and the length detecting sensor 719 is turned on (step S37). In the present embodiment, the width detecting sensor 718 is disposed upstream of the length detecting sensor 719. When the leading end of the recording sheet reaches the length detecting sensor 719, the timer 702 is started (step S38), and it is awaited that the recording sheet leaves the length detecting sensor 719 (step S39). When the recording sheet leaves the length detecting sensor 719, the timer 702 is stopped (step S40). The timer value measured by the timer 702 is then read out, and the length L of the recording sheet is calculated based on the length of time that the length detecting sensor 719 was on (step S41).

A regular-size sheet of which width and length are closest to the value of the width W and the calculated value of the length L is selected, a throughput corresponding to the selected regular-size sheet is retrieved from the throughput timer table (see FIG. 5), and the throughput timer value (Top-top time) is set in the timer 702 (step S42), followed by terminating the process.

As described above, with the multifunction peripheral according to the third embodiment, even if recording sheets are irregular-size sheets, they can be fed at the optimum throughput. It should be noted that as is the case with regular-size sheets, the optimum throughput for irregular-size sheets can be determined in accordance with the ambient temperature and the sheet type.

With the multi-function apparatuses according to the first to third embodiments described above, the fastest printing in continuous printing can be realized at a fixed throughput suitable for conditions such as the continuous printing number and the recording sheet size. In a fourth embodiment of the present invention, however, the fastest printing is realized by changing throughputs so that printing of up to the last page can be completed without causing the temperature at the ends of the two rollers (the heat roller and the pressurizing roller) constituting the fixing unit (hereinafter merely referred to as "the end temperature") to exceed an upper limit. It should be noted that the construction of the multifunction peripheral according to the fourth embodiment is the same as that of the multifunction peripheral according to the first embodiment described above, and therefore description thereof is omitted.

Figure 24:
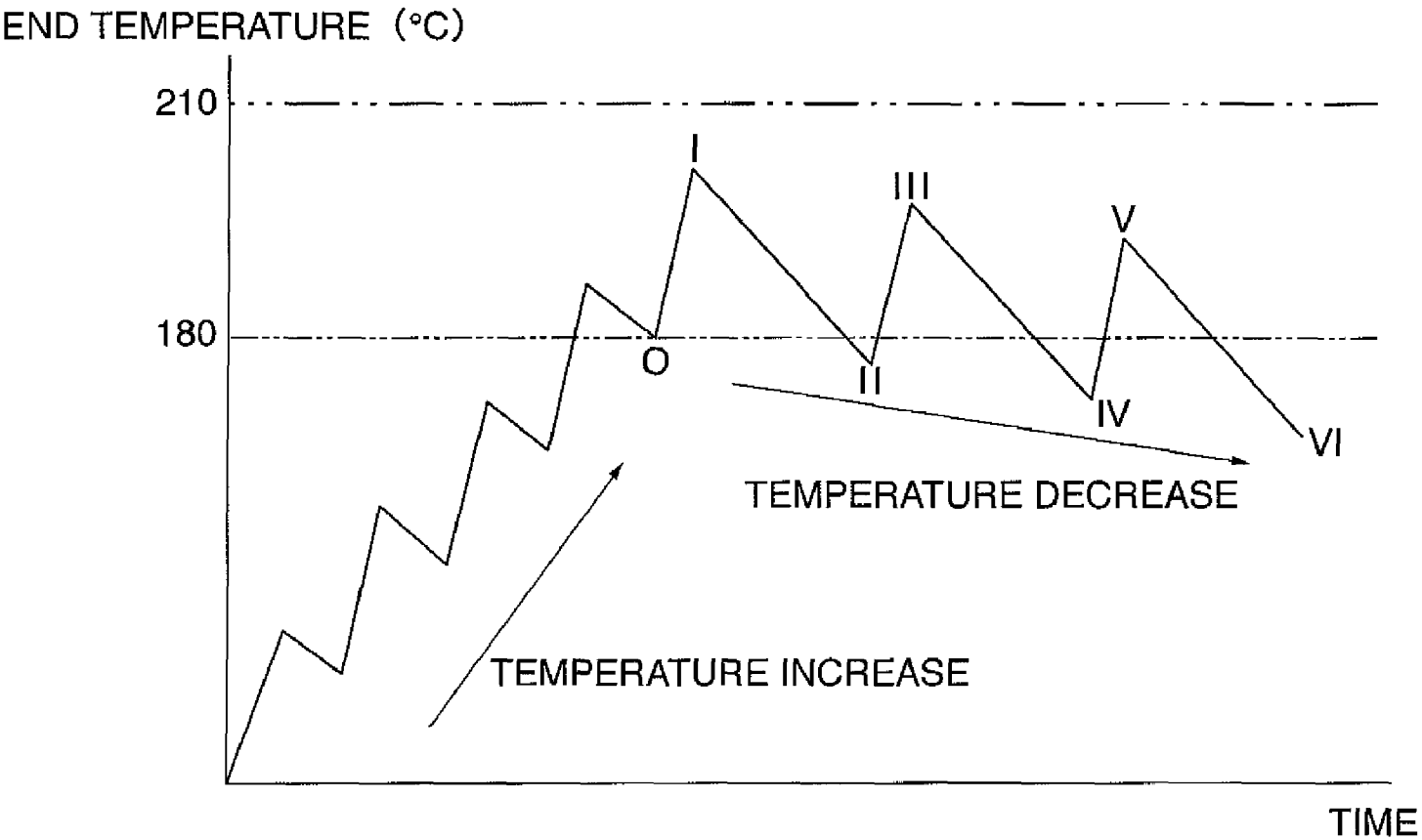
FIG. 24 is a graph showing changes in end temperature which increases and then decreases.
Figure 25:
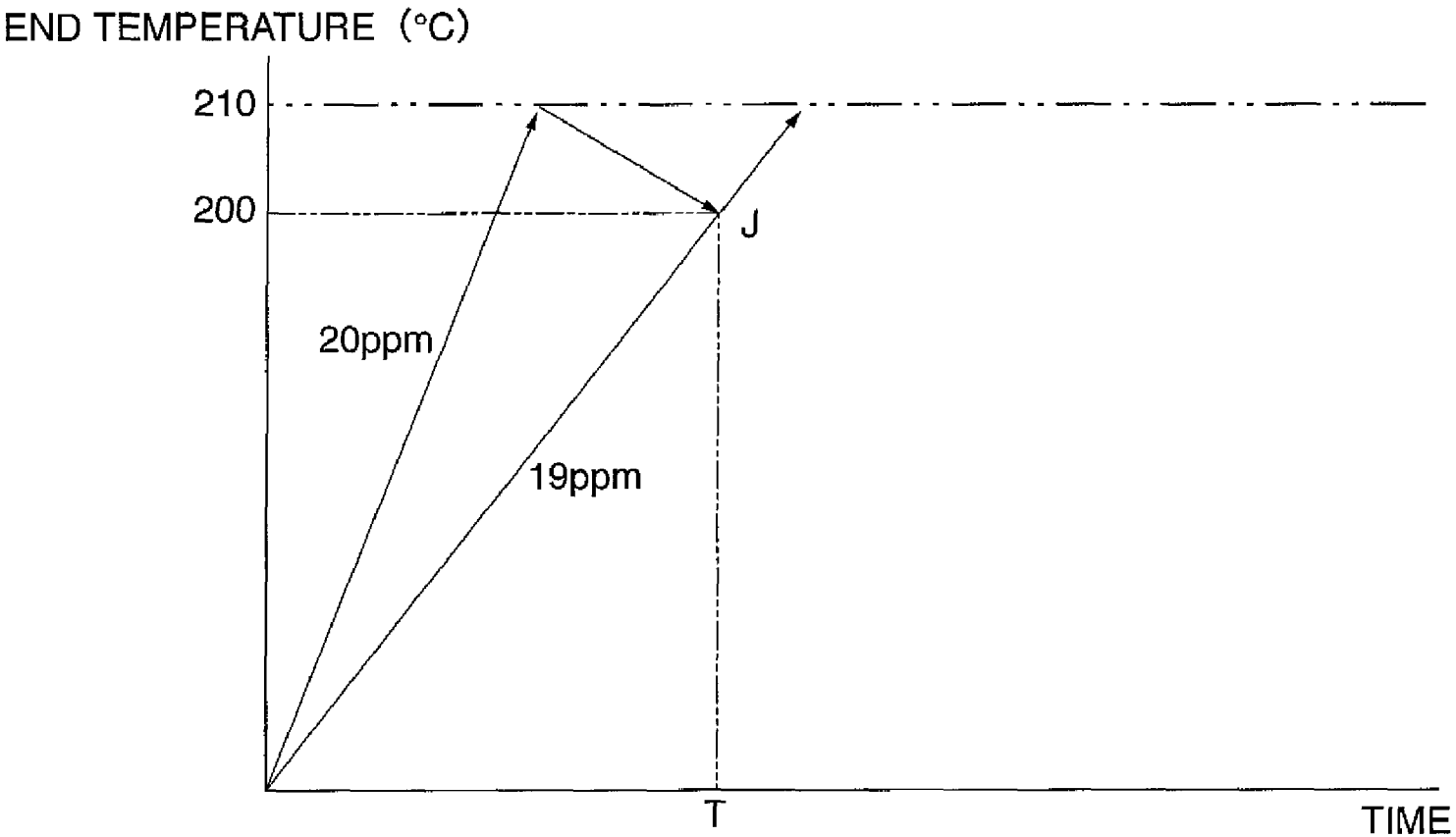
FIG. 25 is a graph showing changes in throughput.

First, how throughputs are changed will be summarized. As described above, the end temperature increases when a recording sheet passes through the nip section of the fixing unit and decreases in the sheet-to-sheet interval. The end temperature repeatedly increases and decreases in this manner to gradually increase. If sheets are passed through the nip section at a sheet-to-sheet interval not less than a predetermined value, the end temperature may gradually decrease. FIG. 24 is a graph showing changes in end temperature which increases and then decreases. FIG. 25 is a graph showing changes in throughput. For example, when passage of recording sheets though the nip section is started at a throughput of 20 ppm, and the sheet-to-sheet interval is increased after the end temperature has reached 210° C. The descending line of the end temperature intersects the ascending line of the end temperature in the case where passage of the sheets is carried out at a throughput of 19 ppm. The intersection J of these lines indicates the same end temperature and the same time with respect to the case where the temperature increases at the throughput of 19 ppm from the beginning and the case where the end temperature increases first at the throughput of 20 ppm and then decreases. Thus, by changing the throughput to 19 ppm after the end temperature reaches the intersection J, the ascending line of the end temperature is caused to change in the same manner as the ascending line of the end temperature in the case where passage of the sheets is carried out at the throughput of 19 ppm from the beginning.

Figure 26:
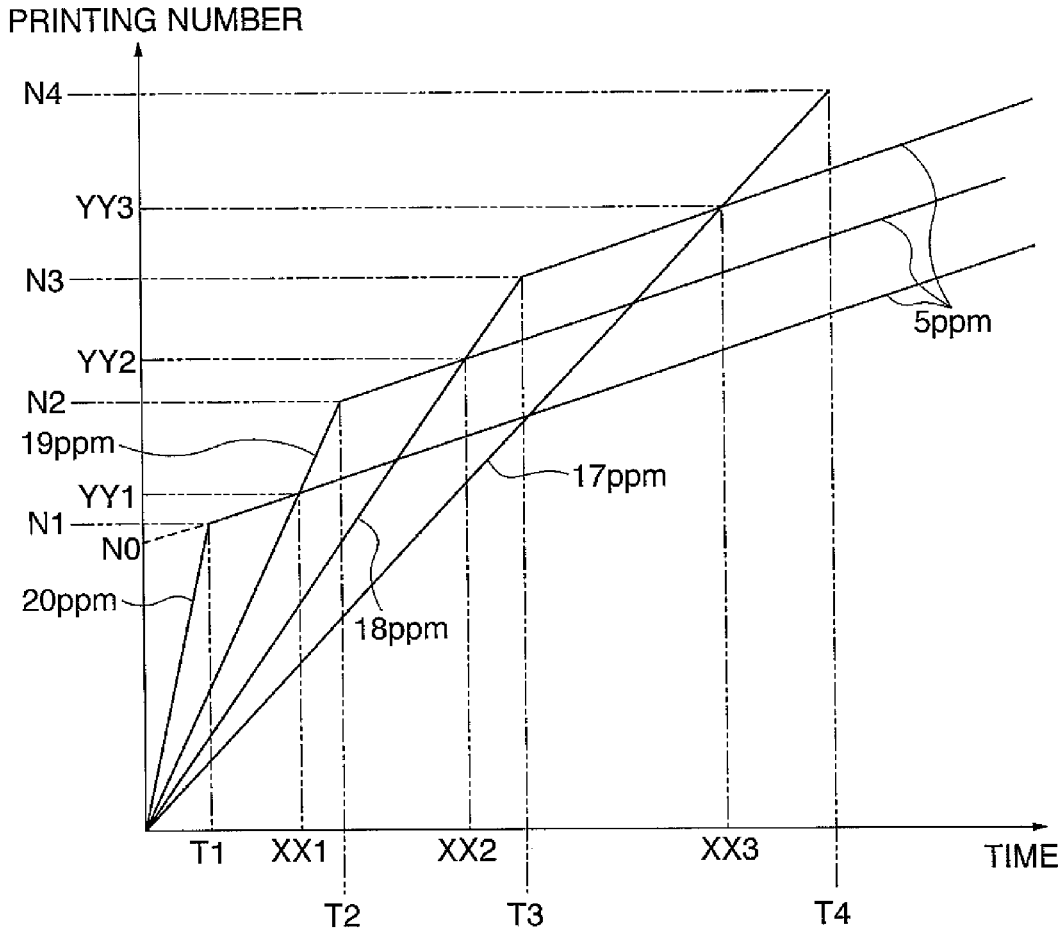
FIG. 26 is a graph showing changes in throughput at intersections during the passage of sheets.

Next, a concrete example of how the throughput is changed will be described. FIG. 26 is a graph showing changes in throughput which is changed at intersections during passage of sheets. The ordinate indicates the number of prints, and the abscissa indicates the printing time. For example, passage of sheets is carried out at a throughput of 20 ppm up to a point (T1, N1), and after that, the throughput is decreased. When a point (XX1, YY1) is reached, the throughput is changed to 19 ppm, and the throughput of 19 ppm is maintained until a point (T2, N2) is reached. This is repeated to continuously produce a desired number of prints.

FIG. 27 is a table that exhibits coordinates at respective points in FIG. 26. For example, the point (XX1, YY1) is represented by the following mathematical expression (2) using the point (T1, N1):

$$XX1=(N1-5\times T1)/14,\ YY1=19\times(N1-5\times T1)/14 \quad (2)$$

This table is stored in the table memory 731 within the engine controller and referred to by the CPU 701 when necessary.

Figure 28:
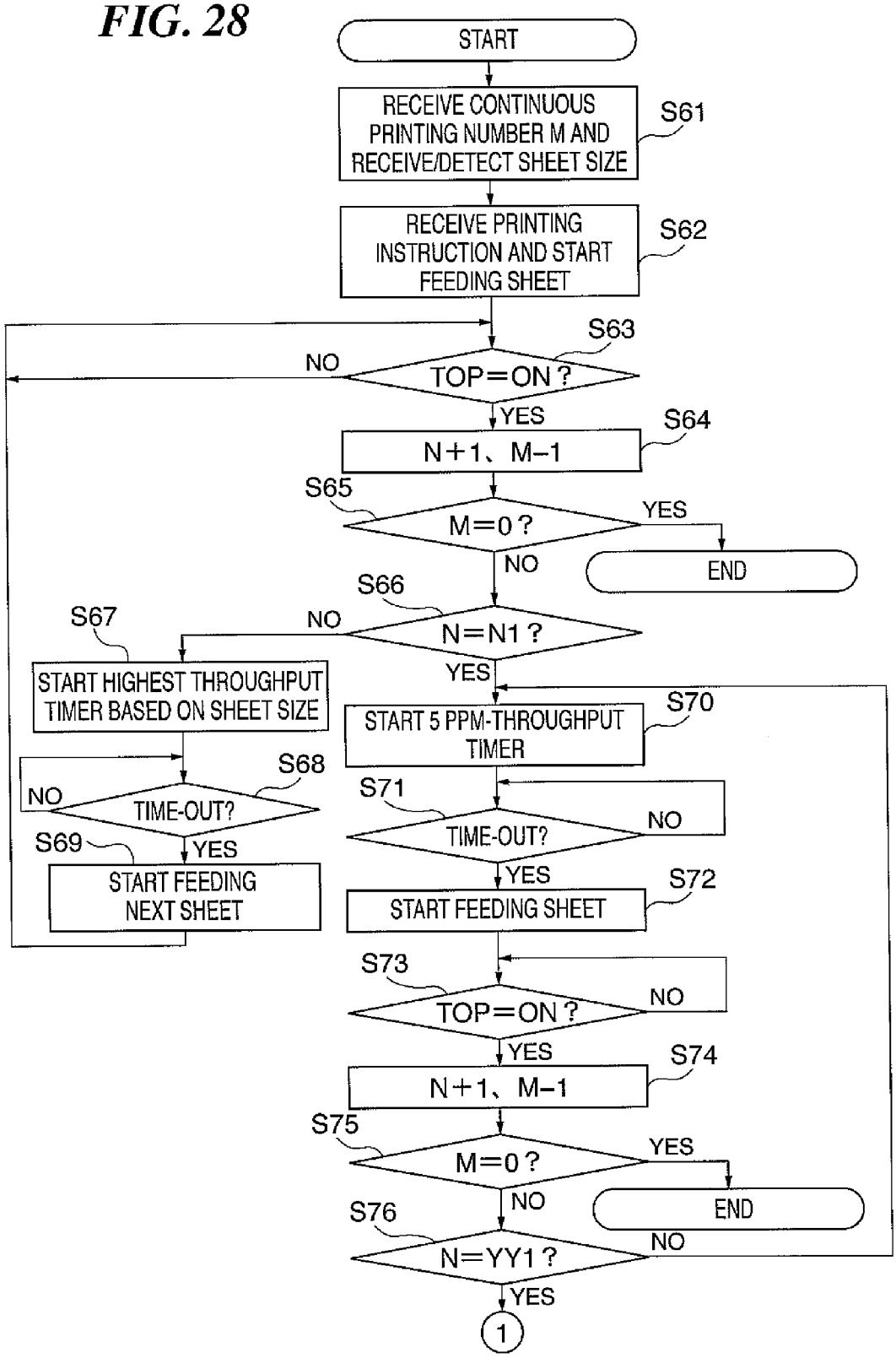
FIG. 28 is a flowchart showing the procedure of a sheet feeding process.
Figure 29:
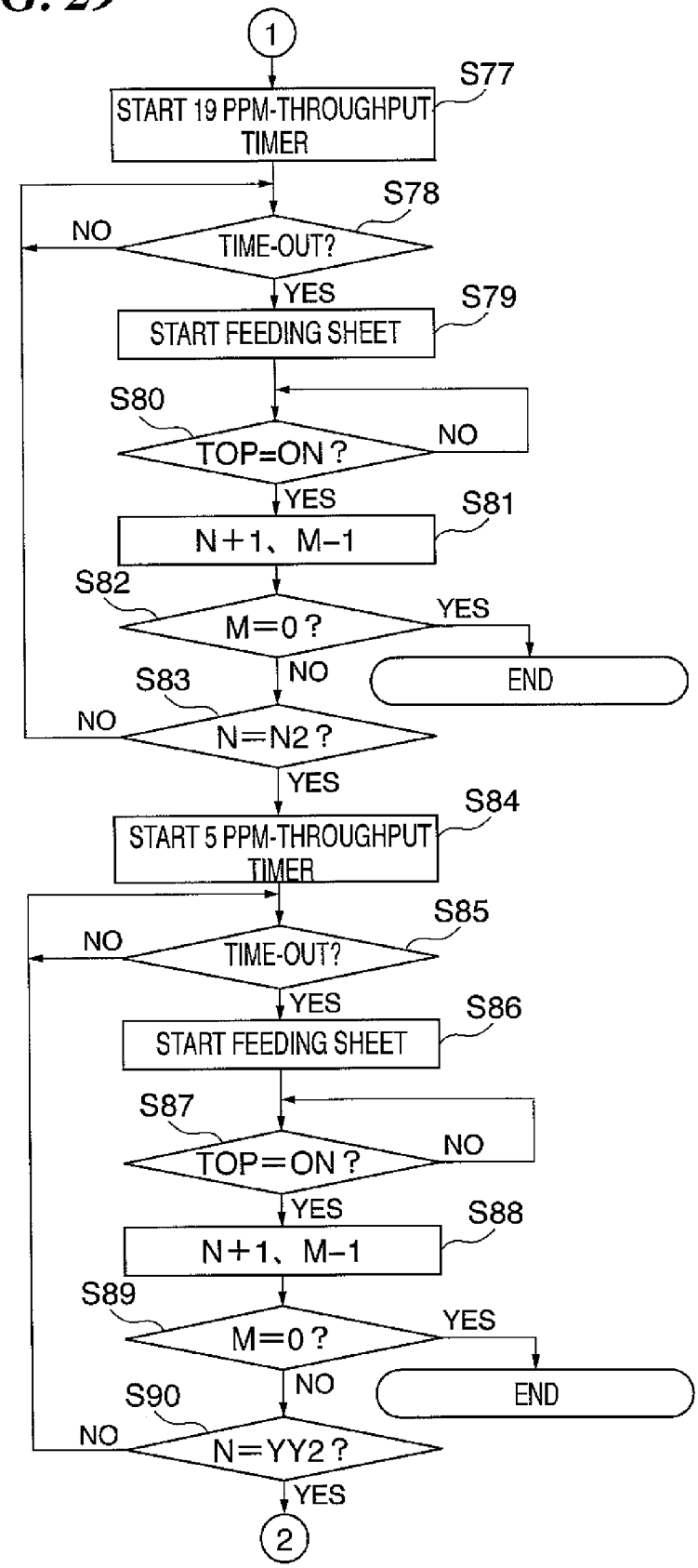
FIG. 29 is a flowchart showing a continued part of the sheet feeding process in FIG. 28.
Figure 30:
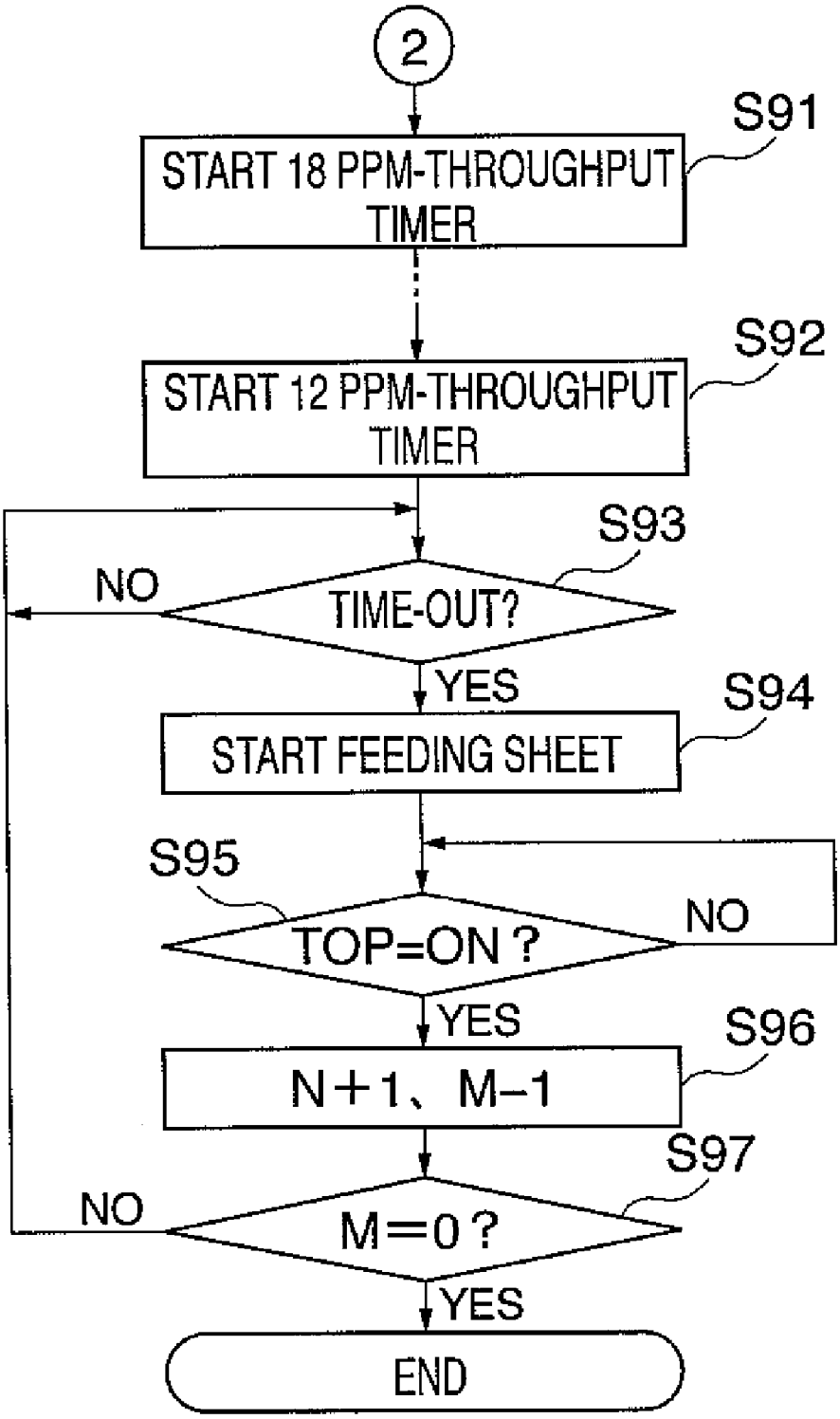
FIG. 30 is a flowchart showing a continued part of the sheet feeding process in FIGS. 28 and 29.

A description will now be given of how recording sheets are fed in the multifunction peripheral according to the fourth embodiment constructed as described above. FIGS. 28 to 30 are flowcharts showing the procedure of a sheet feeding process. A processing program for implementing this process is stored in the ROM 703 within the engine controller and executed by the CPU 701. The continuous printing number and the sheet size set through the operation of the operating unit 140 by the operator are stored in advance in the number of continuously produced prints setting section 314*a* and the sheet size setting section 314*b*, respectively.

First, the continuous printing number M and the recording sheet size are received from the controller unit (main controller) 30 (step S61). Further, upon receiving a printing instruction, feeding of a recording sheet is started (step S62).

It is awaited that the leading end of the recording sheet reaches the location at which the Top sensor 711 is disposed and the Top sensor 711 is turned on (step S63). When the Top sensor 11 is turned on, the number of fed sheets N is incremented by 1, and the continuous printing number M is decremented by 1 (step S64). It should be noted that the initial value of the number of fed sheets N is 0. It is then determined whether or not the continuous printing number M is 0 (step S65). If the continuous printing number M is 0, the process is terminated.

On the other hand, if the continuous printing number M is not 0, it is then determined whether or not the number of fed sheets N has become equal to a value N1 (step S66). If the number of fed sheets N has not become equal to the value N1, the Top-top time corresponding to the highest throughput is set in the timer 702, and operation of the timer 702 is started so that the recording sheet can be fed at the highest throughput (step S67). In the present embodiment, the highest throughput is 20 ppm. It should be noted that as described above, the highest throughput is set in accordance with the recording sheet size, sheet type, ambient temperature, and so forth, as well as the continuous printing number. Time-out is then awaited (step S68). Upon time-out, feeding of the next recording sheet is started (step S69). The process then returns to the step S63. That is, recording sheets are fed at the highest throughput of 20 ppm until the number of fed sheets N becomes equal to the value N1.

On the other hand, if it is determined in the step S66 that the number of fed sheets N has become equal to the value N1, the Top-top time corresponding to a throughput of 5 ppm is set in the timer 702, and operation of the timer 702 is started (step S70). In this case, the sheet-to-sheet interval corresponds to the throughput of 5 ppm. Time-out is then awaited (step S71). Upon time-out, feeding of the next recording sheet is started (step S72).

After that, as in the steps S63 to S65 described above, It is awaited that the leading end of the recording sheet reaches the location at which the Top sensor 711 is disposed and the Top sensor 711 is turned on (step S73). When the Top sensor 11 is turned on, the number of fed sheets N is incremented by 1, and the continuous printing number M is decremented by 1 (step S74). It is then determined whether or not the continuous printing number M is 0 (step S75). If the continuous printing number M is 0, the process is terminated. On the other hand, if the continuous printing number M is not 0, it is then determined whether or not the number of fed sheets N has become equal to a value YY1 (step S76). If the number of fed sheets N has not become equal to the value YY1, the process returns to the step S70 so as to continue feeding sheets at the throughput of 5 ppm.

On the other hand, if it is determined in the step S76 that the number of fed sheets N has become equal to the value YY1, the Top-top time corresponding to a throughput of 19 ppm is set in the timer 702, and operation of the timer 702 is started (step S77). Time-out is then awaited (step S78), and upon time-out, feeding of the next recording sheet is started (step S79).

The subsequent steps S80 to S91 are the same as the respective steps S63 to S77 described above. Specifically, when the number of fed sheets N becomes equal to a value N2, the Top-top time corresponding to a throughput of 5 ppm is set in the timer 702, and operation of the timer 702 suitable is started, and when the number of fed sheets N becomes equal to a value YY2, the Top-top time corresponding to a throughput of 18 ppm is set in the timer 702, and operation of the timer 702 is started.

The above described process in which the throughput is decreased (the same process as in the steps S63 to S77) is repeatedly carried out until the throughput comes down to 12 pm (steps S92 to S97). Specifically, if it is determined in the step S97 that the continuous printing number M is not 0, the throughput is unchanged at 12 ppm, and the process returns to the step S93.

Figure 31:
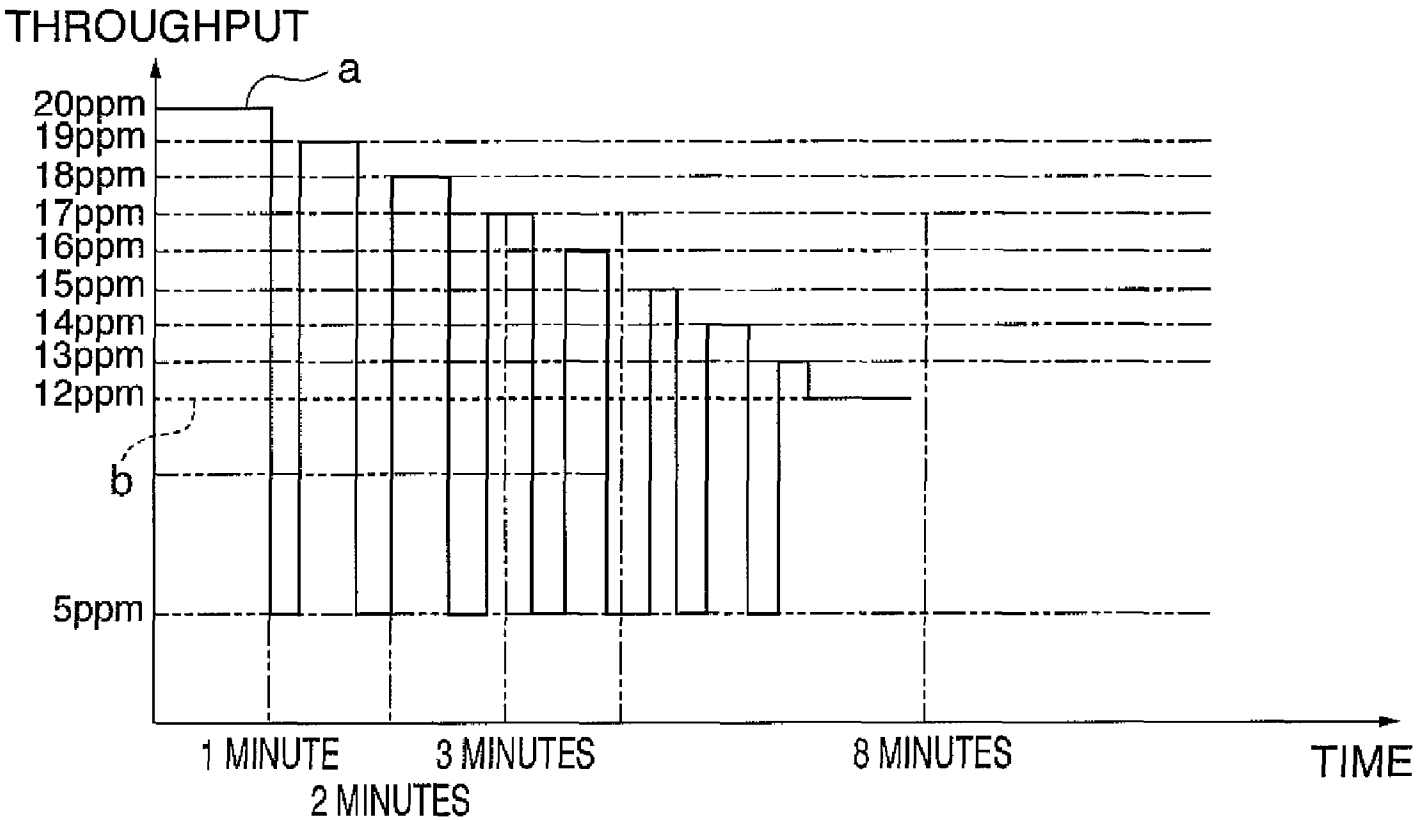
FIG. 31 is a graph showing time changes in throughput.

FIG. 31 is a graph showing time changes in throughput. In a feeding operation a in which the throughput is sequentially decreased from 20 ppm to 12 ppm as described above with reference to FIGS. 28 to 30, and a feeding operation b in which the throughput is fixed at 12 ppm from the beginning as in the first embodiment described above, the time required to complete printing is the same, i.e. almost 8 minutes. However, if such a change as to decrease the continuous printing number occurs during printing, the time required to complete printing can be shorter in the case where feeding is started at the throughput of 20 ppm. Also, if the optimum throughput such as 12 ppm is unknown, controlling the throughput to change in the above mentioned manner can realize a throughput close to the optimum throughput as a whole.

As described above, with the multifunction peripheral according to the fourth embodiment, the rising throughput at which the end temperature reaches the upper limit is started from the highest throughput. The rising throughput is changed to decrease step by step with the falling throughput at which the end temperature surely decreases being interposed between throughput changes. This can realize the fastest printing with respect to each number of prints to be continuously produced while preventing an increase in end temperature. Thus, the performance of the apparatus can be made closer and closer to the performance that realizes passage of sheets at the highest throughput, giving the user a feeling of satisfaction.

Although in the above described embodiment, after being decreased to 5 ppm, the rising throughput is simply changed to the next rising throughput which is 1 ppm lower, the value to which the next rising throughput is set is arbitrarily determined in accordance with various conditions. Examples of the conditions for determining the value to which the next rising throughput is set include the continuous printing number, ambient temperature, recording sheet size, sheet type, and the length of time that printing continues from the start of printing.

Figure 32:
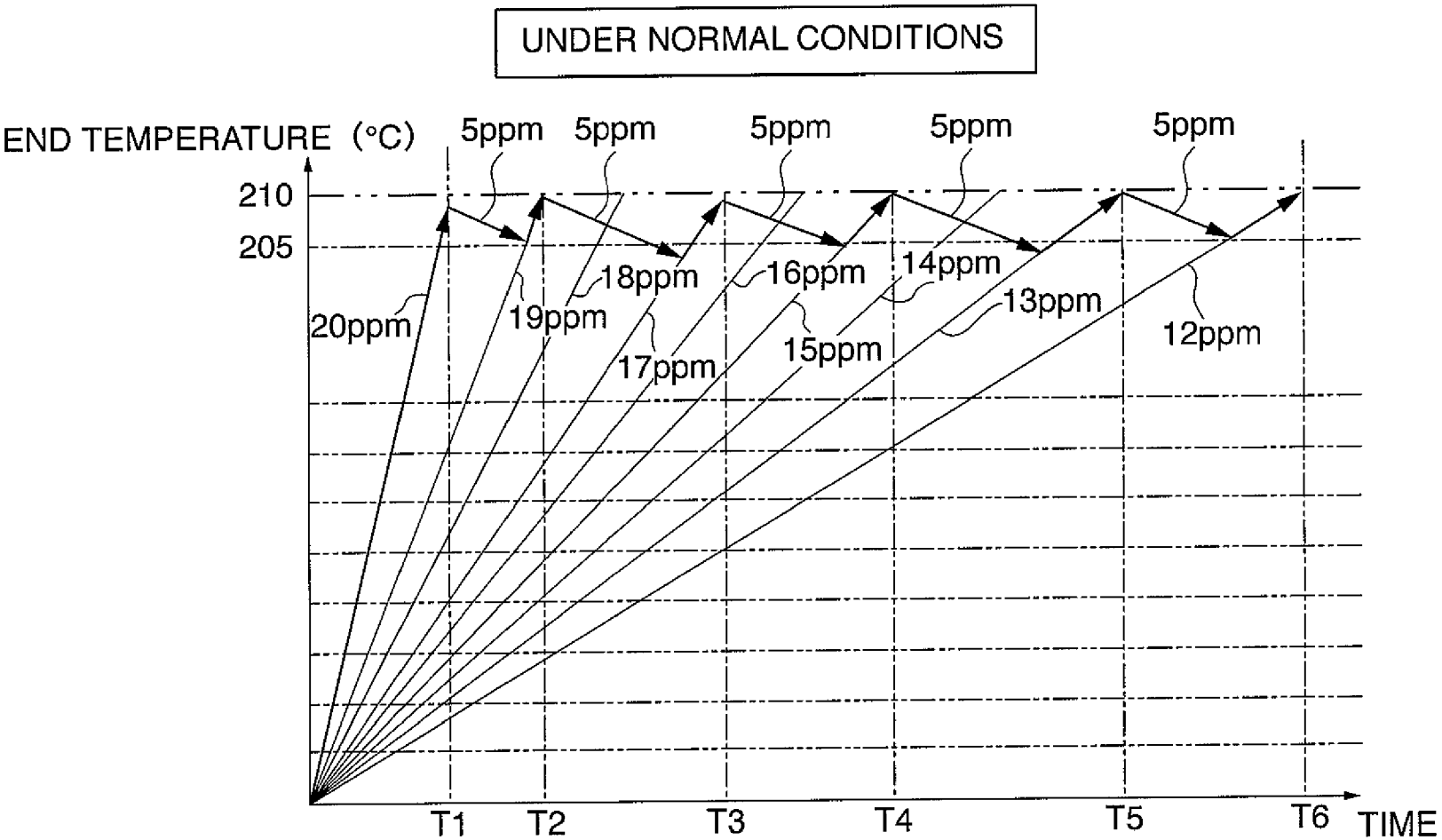
FIG. 32 is a graph showing changes in throughput under normal conditions.
Figure 33:
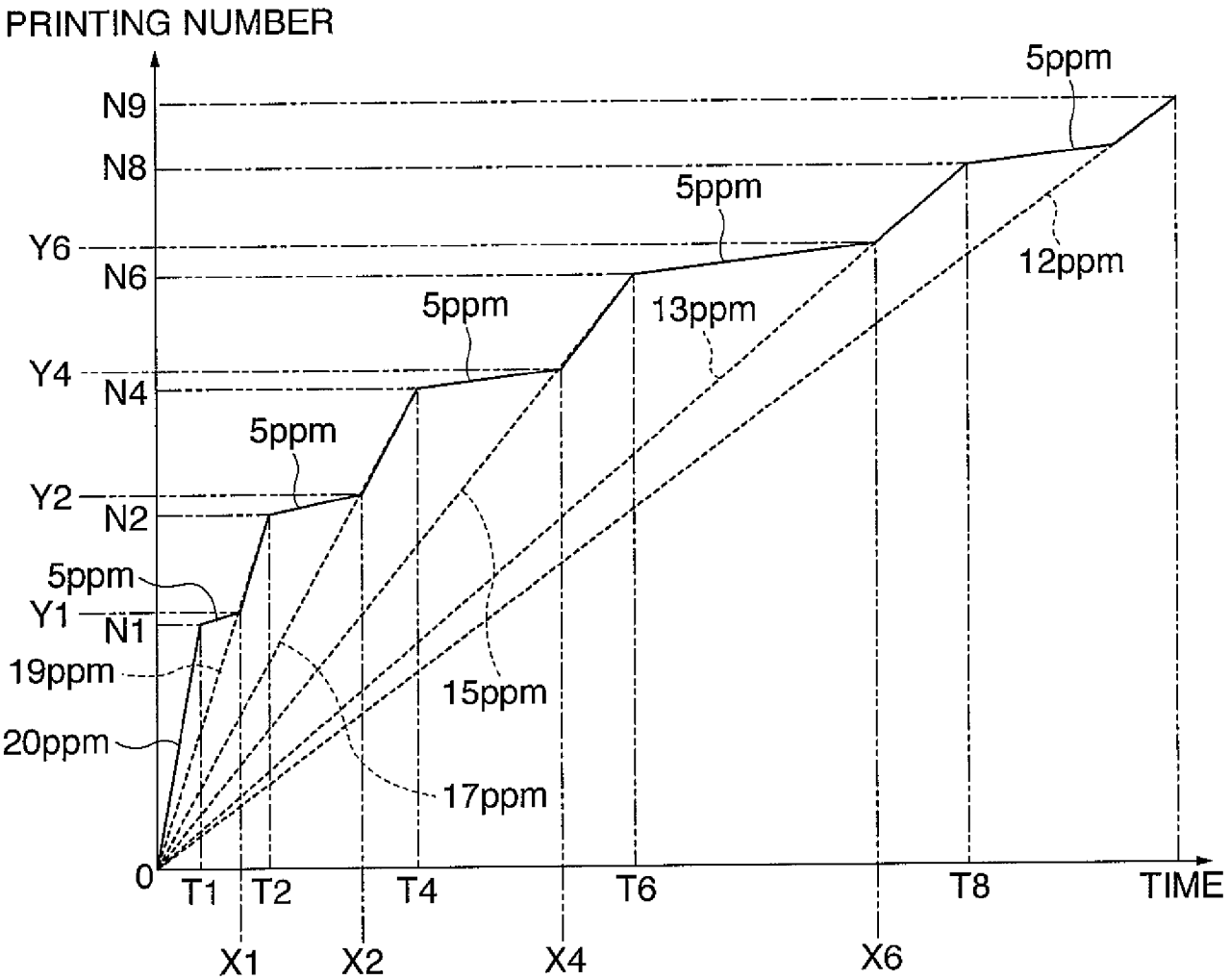
FIG. 33 is a graph showing time changes in the number of prints to be produced in the case where the throughput is changed as shown in FIG. 32.

FIG. 32 is a graph showing changes in throughput under normal conditions. FIG. 33 is a graph showing time changes in the number of prints to be produced in the case where the throughput is changed as shown in FIG. 32. In this case, after being decreased to 5 ppm at the upper limit (210° C.), the throughput is changed to a throughput at which the end temperature intersects a predetermined temperature around 205° C. Thus, the throughput is changed as follows: 20 ppm→19 ppm→17 ppm→15 ppm→13 ppm→12 ppm.

Figure 34:
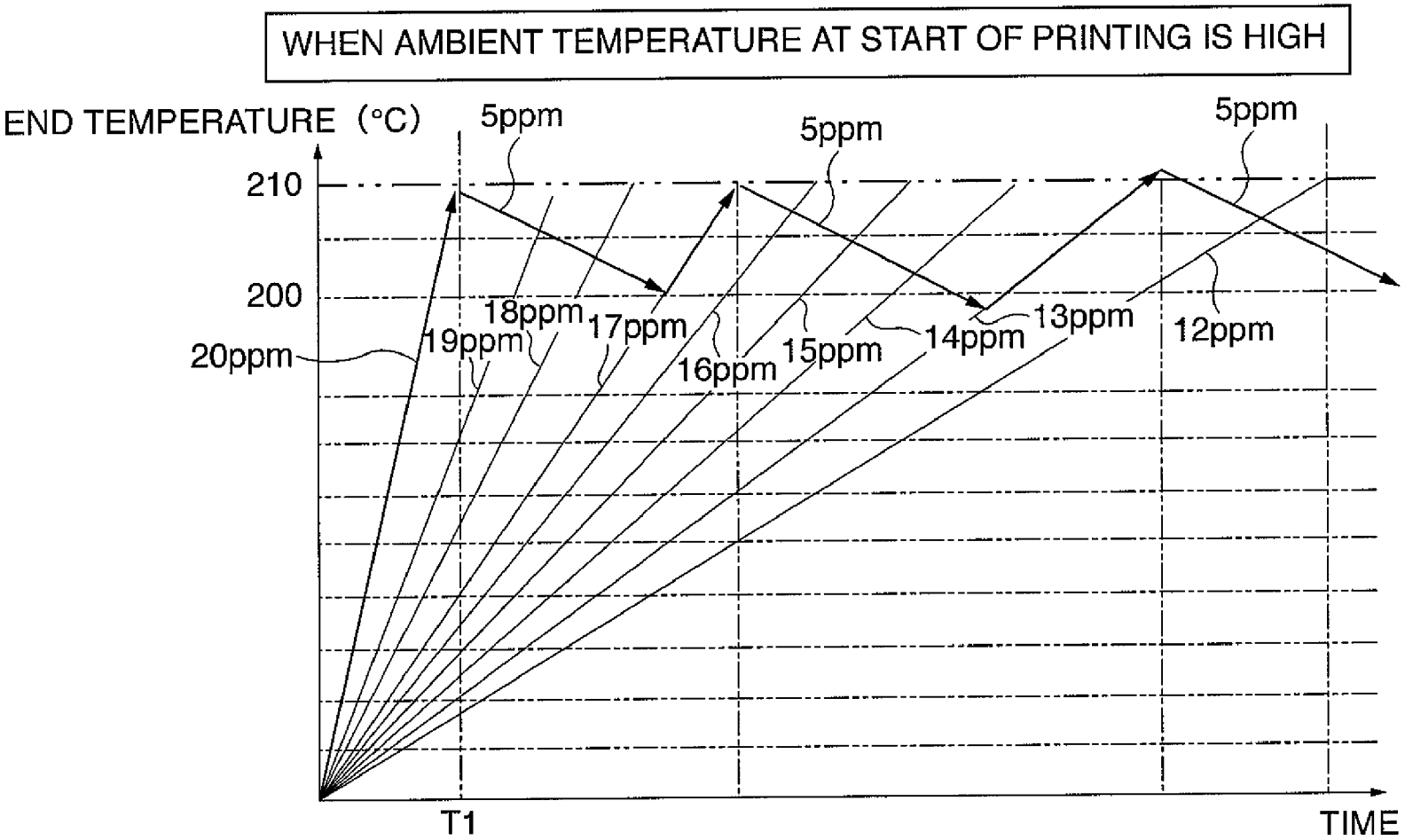
FIG. 34 is a graph showing changes in throughput in the case where the ambient temperature is high at the start of printing.
Figure 35:
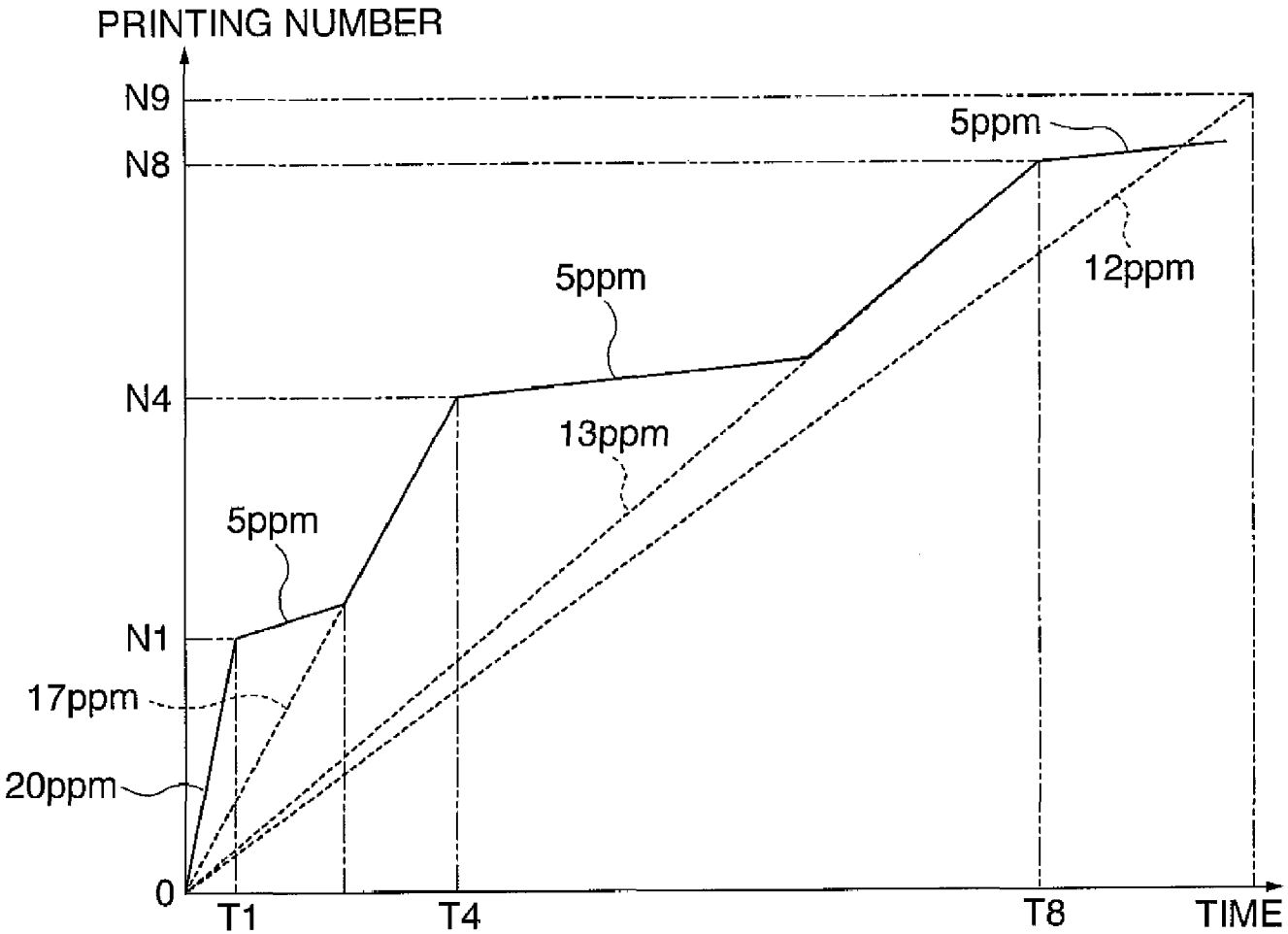
FIG. 35 is a graph showing time changes in the number of prints to be produced in the case where the throughput is changed as shown in FIG. 34.

FIG. 34 is a graph showing changes in throughput in the case where the ambient temperature is high at the start of printing. FIG. 35 is a graph showing time changes in the number of prints to be produced in the case where the throughput is changed as shown in FIG. 34. In this case, after being decreased to 5 ppm at the upper limit, the throughput is changed to a throughput at which the end temperature intersects a predetermined temperature around 200° C. Thus, the throughput is changed as follows: 20 ppm→17 ppm→13 ppm.

Figure 36:
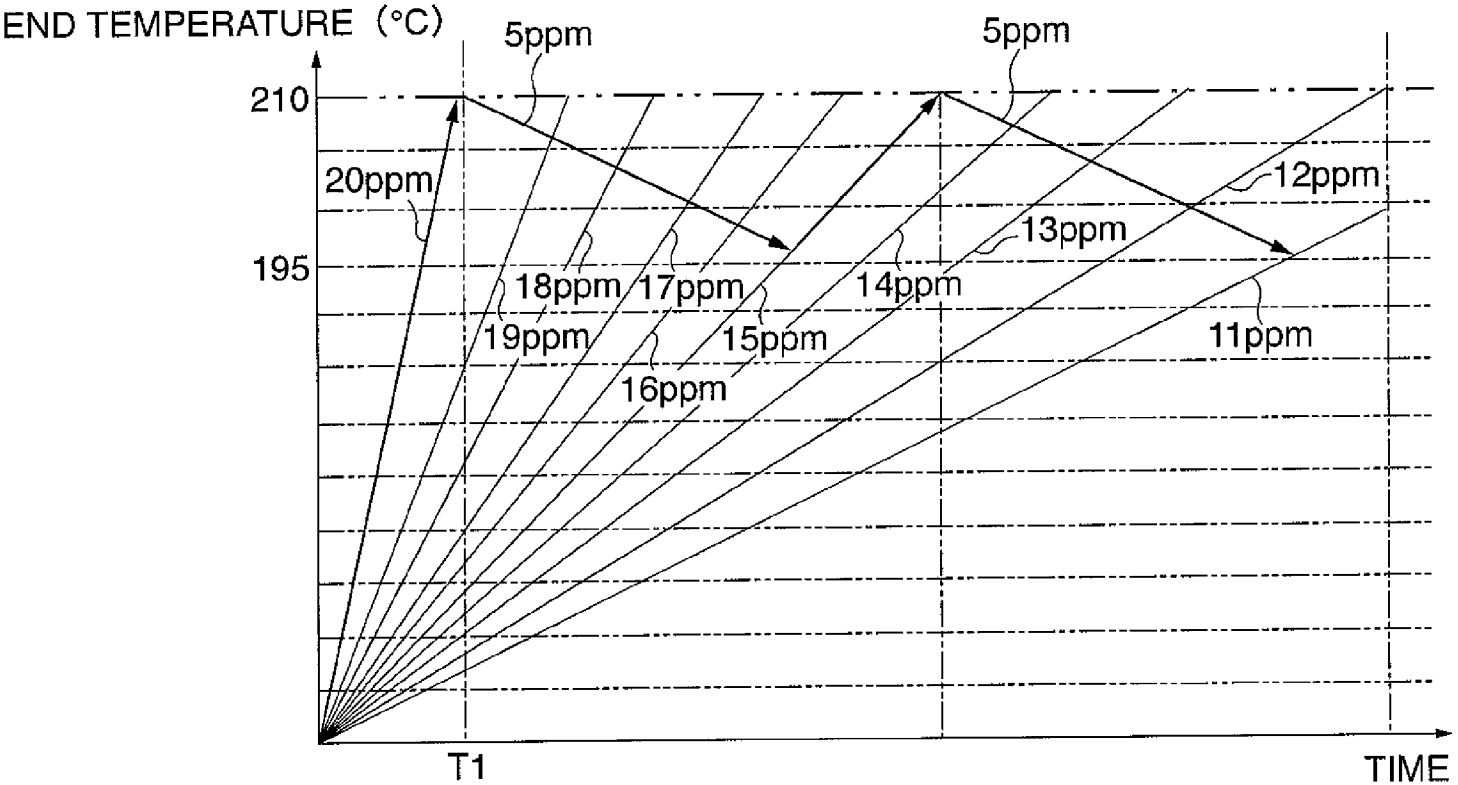
FIG. 36 is a graph showing changes in throughput in the case where recording sheets are thick or wide sheets.
Figure 37:
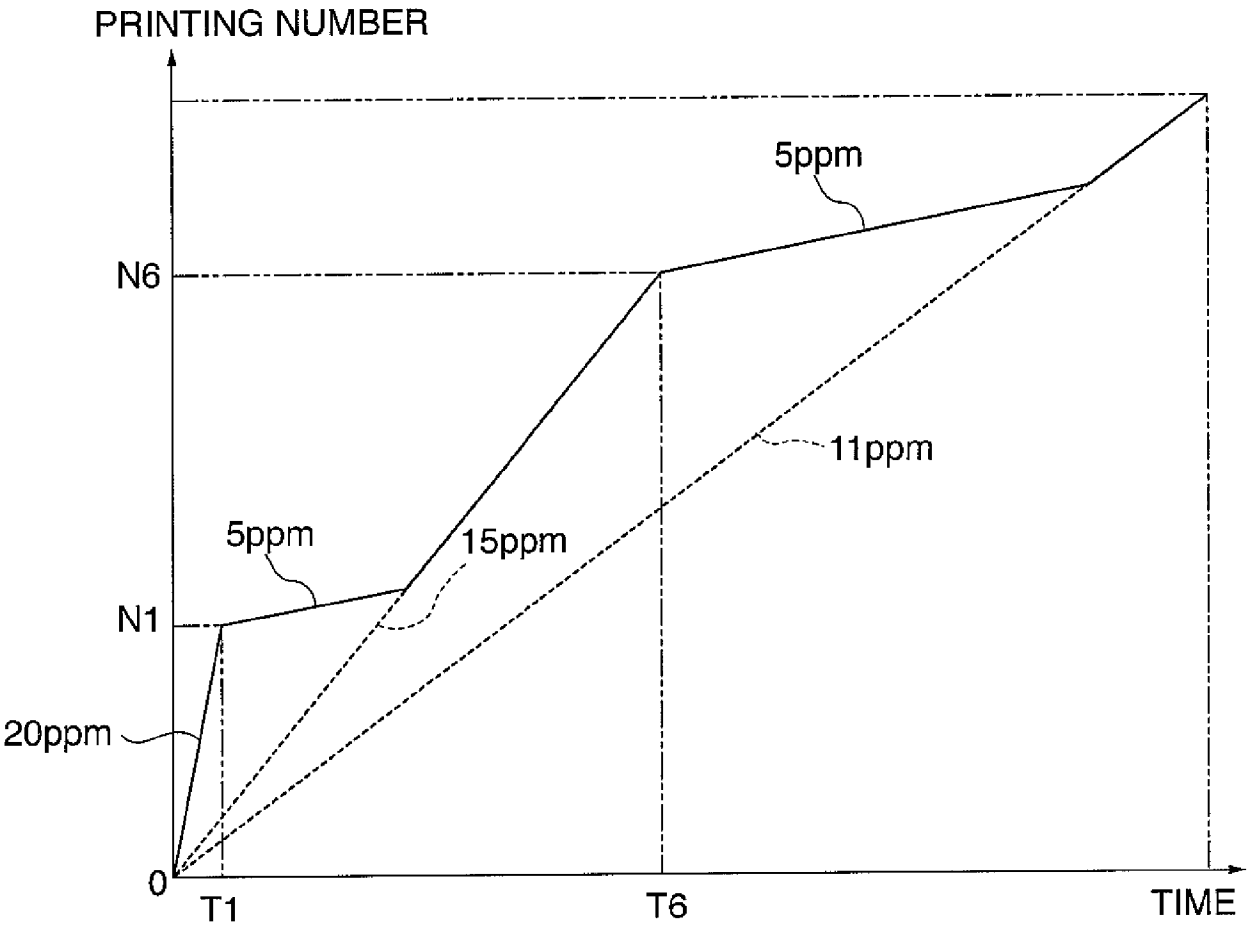
FIG. 37 is a graph showing time changes in the number of prints to be produced in the case where the throughput is changed as shown in FIG. 36.

FIG. 36 is a graph showing changes in throughput in the case where recording sheets are thick sheet or wide sheets. FIG. 37 is a graph showing time changes in the number of prints to be produced in the case where the throughput is changed as shown in FIG. 36. In this case, after being decreased to 5 ppm at the upper limit, the throughput is changed to a throughput at which the end temperature intersects a predetermined temperature around 195° C. Thus, the throughput is changed as follows: 20 ppm→15 ppm→11 ppm.

Figure 38:
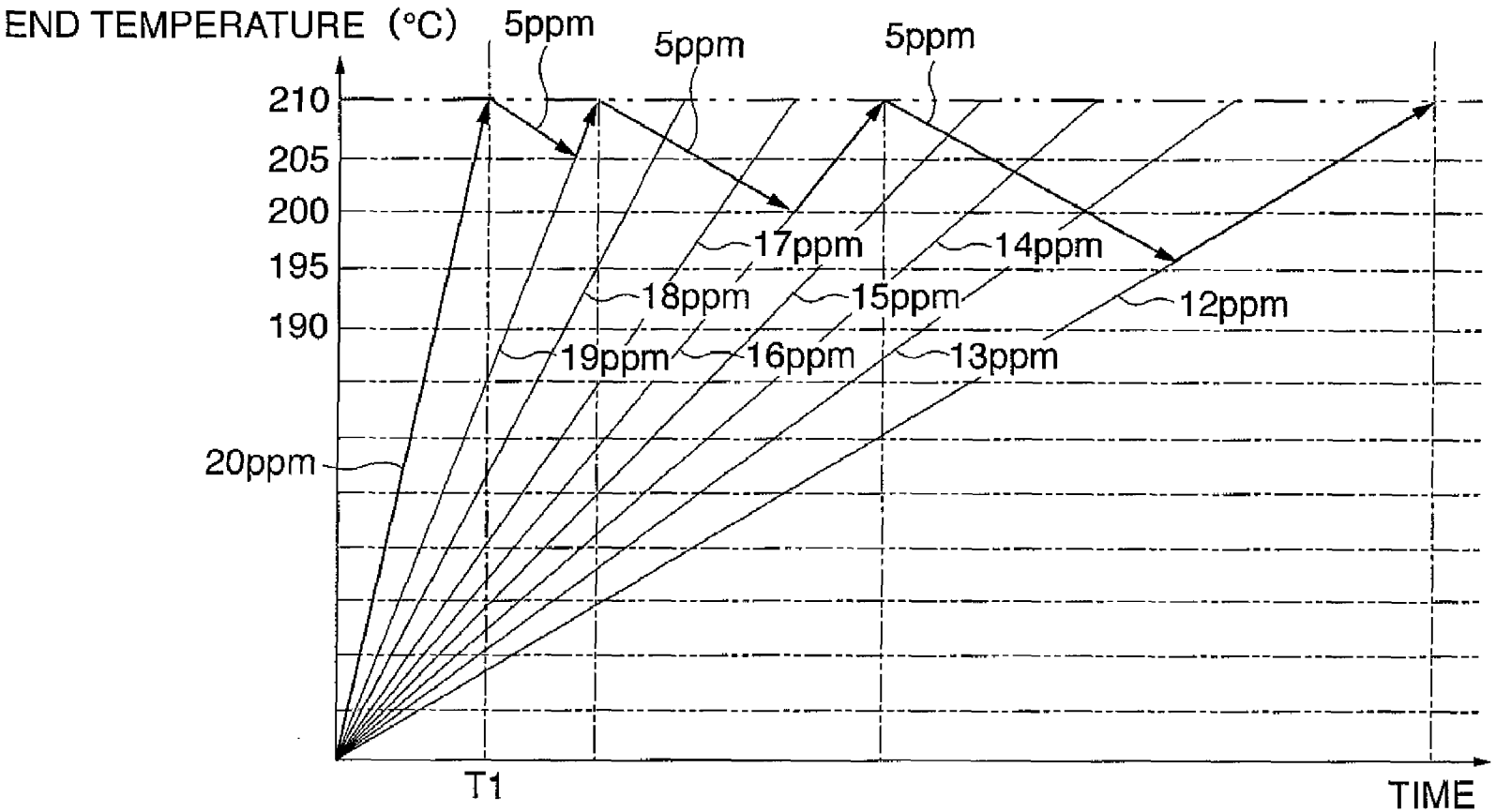
FIG. 38 is a graph showing time changes in the number of prints to be produced in the case where a large amount of heat is stored due to long-duration printing.
Figure 39:
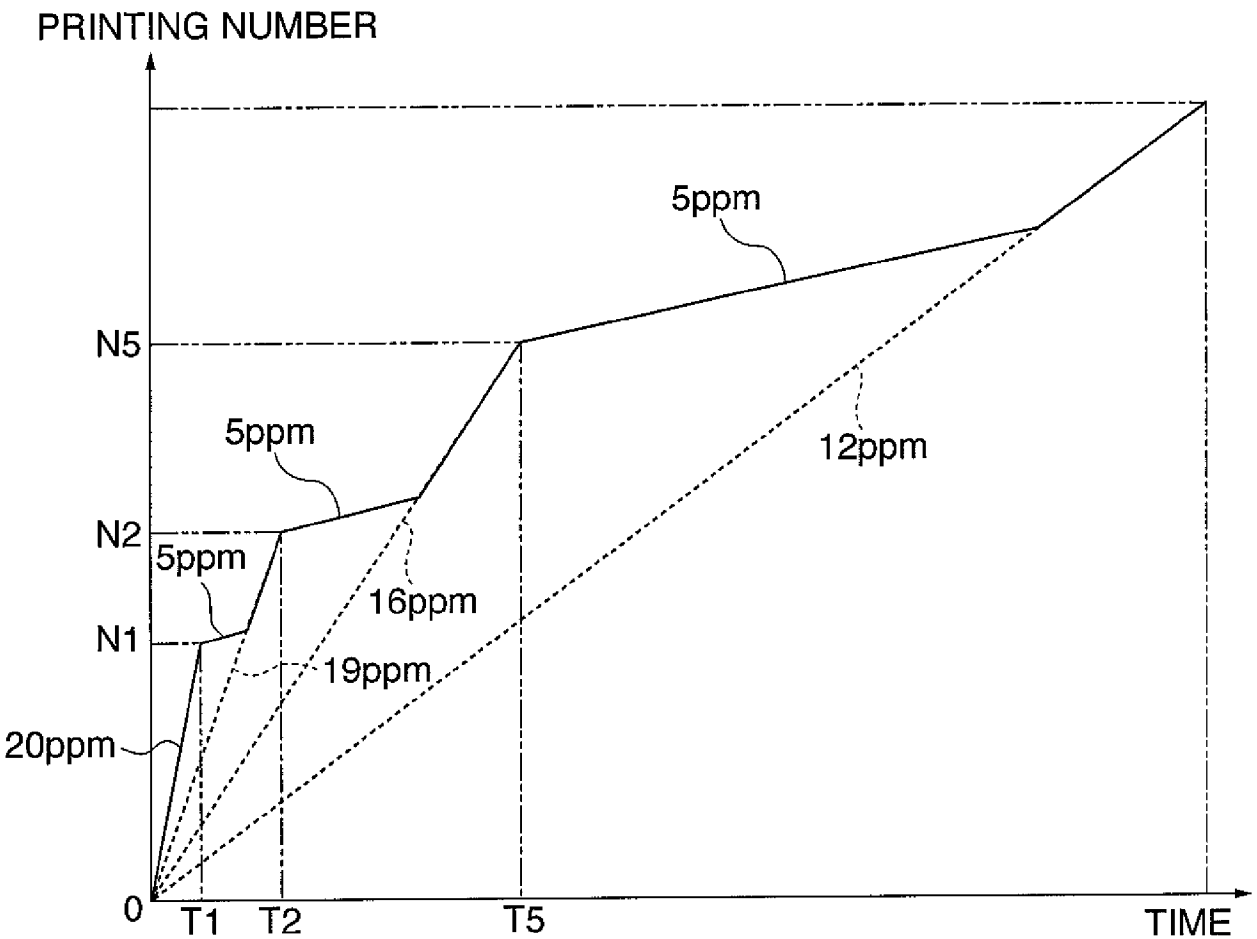
FIG. 39 is a graph showing time changes in the number of prints to be produced in the case where the throughput is changed as shown in FIG. 38.
Figure 40:
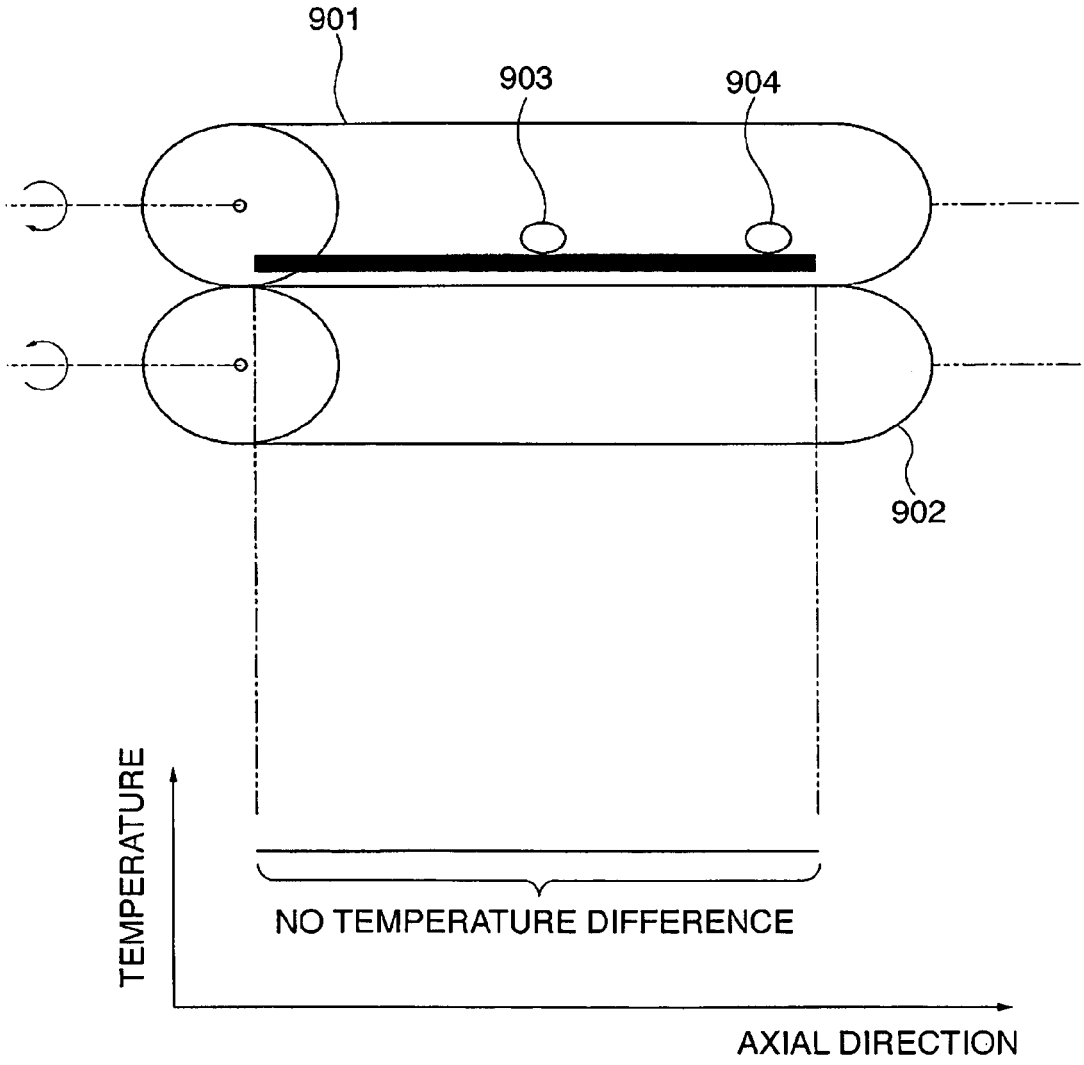
(PRIOR ART) FIG. 40
FIG. 40 is a diagram showing the axial direction-wise distribution in a nip section of a conventional fixing unit.
Figure 41:
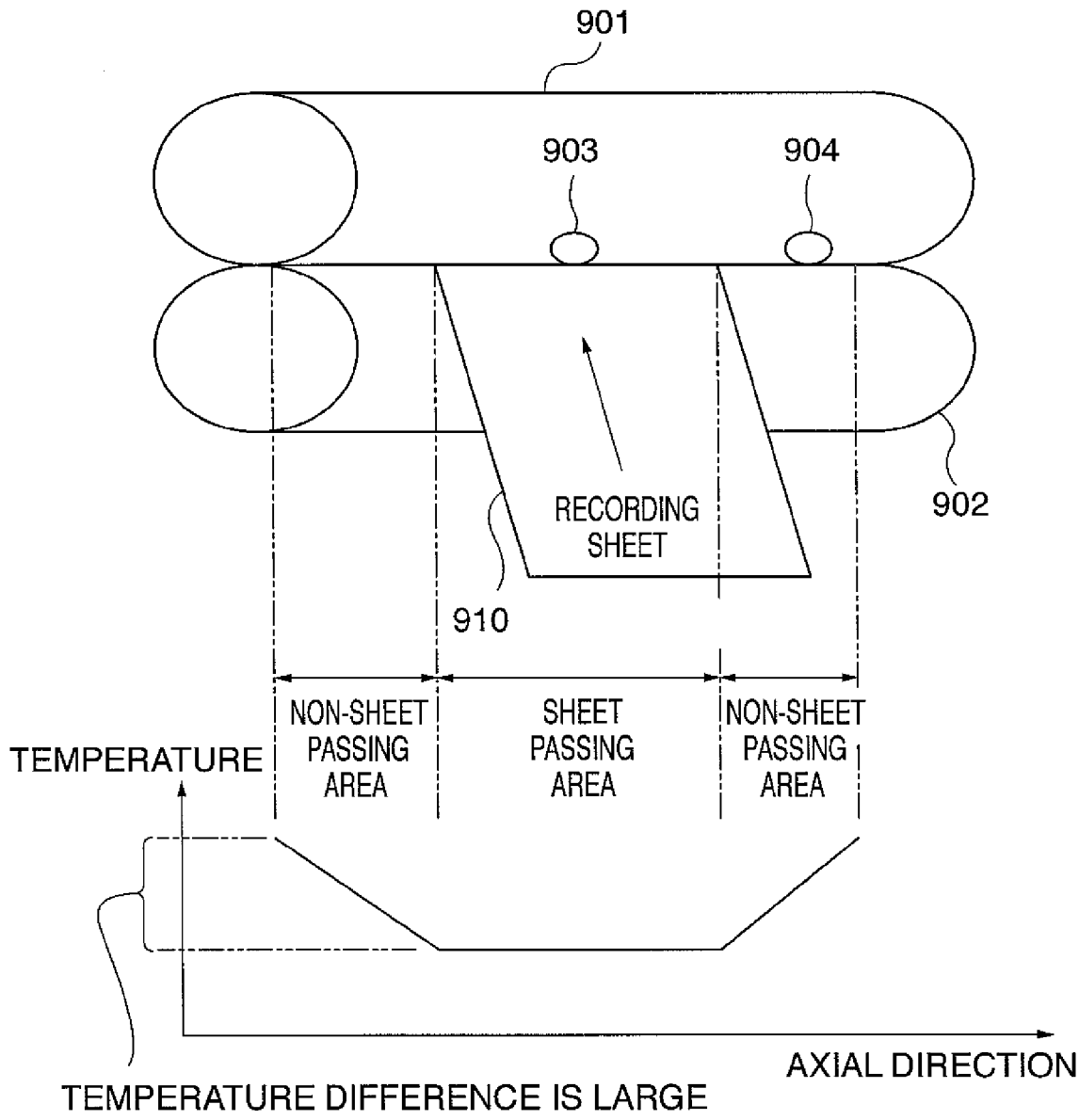
FIG. 41 is a diagram showing the axial direction-wise distribution in the nip section when a recording material passes through the midsection of rollers.
Figure 42:
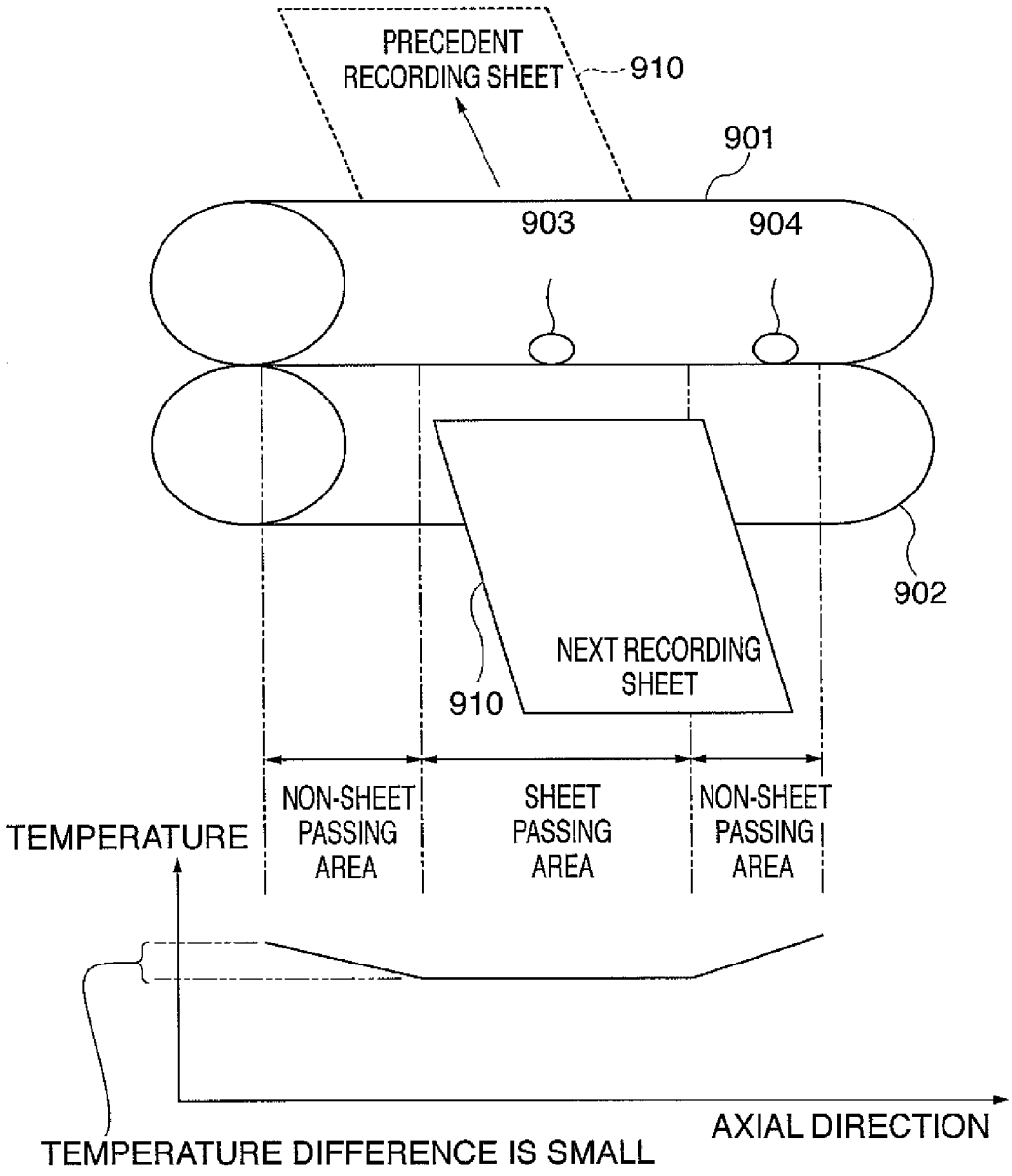
FIG. 42 is a diagram showing the axial direction-wise distribution in the nip section when sheets are continuously passed through the nip section.
Figure 43A:
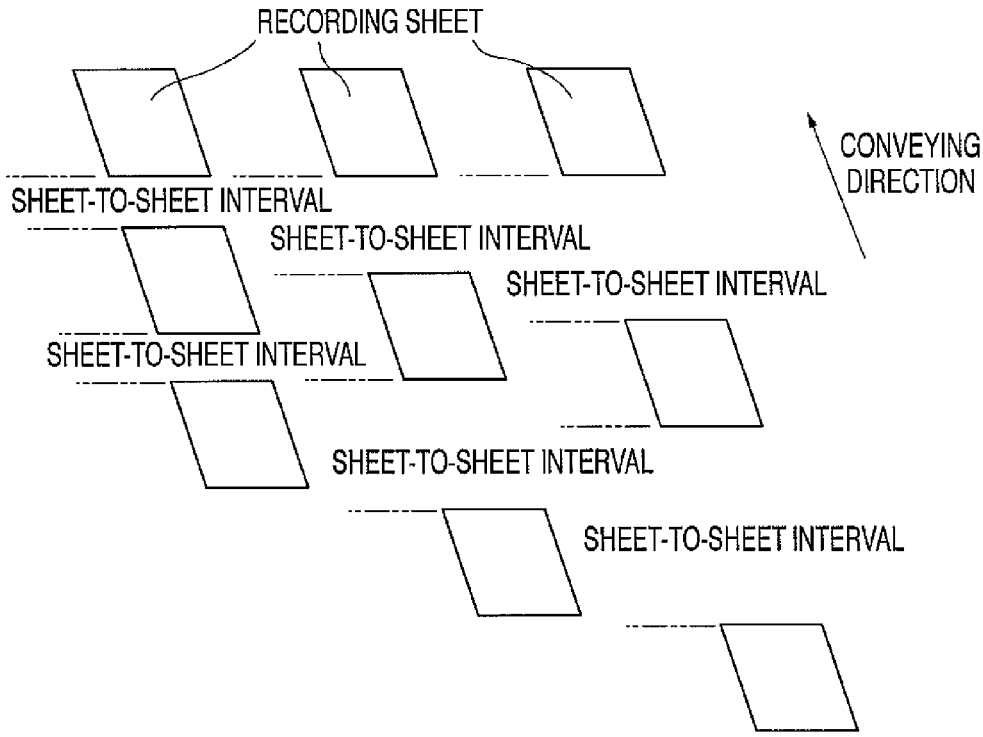
FIG. 43A is a diagram showing states in which sheets are conveyed at different sheet-to-sheet intervals.
Figure 43B:
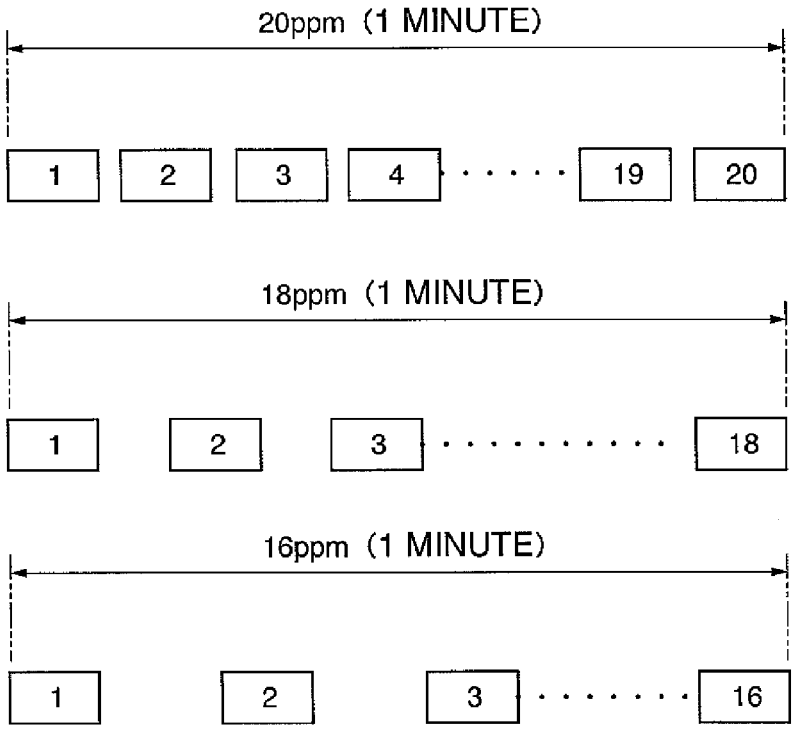
FIG. 43B is a diagram showing the number of sheets conveyed per minute with respect to each sheet-to-sheet interval.
Figure 44:
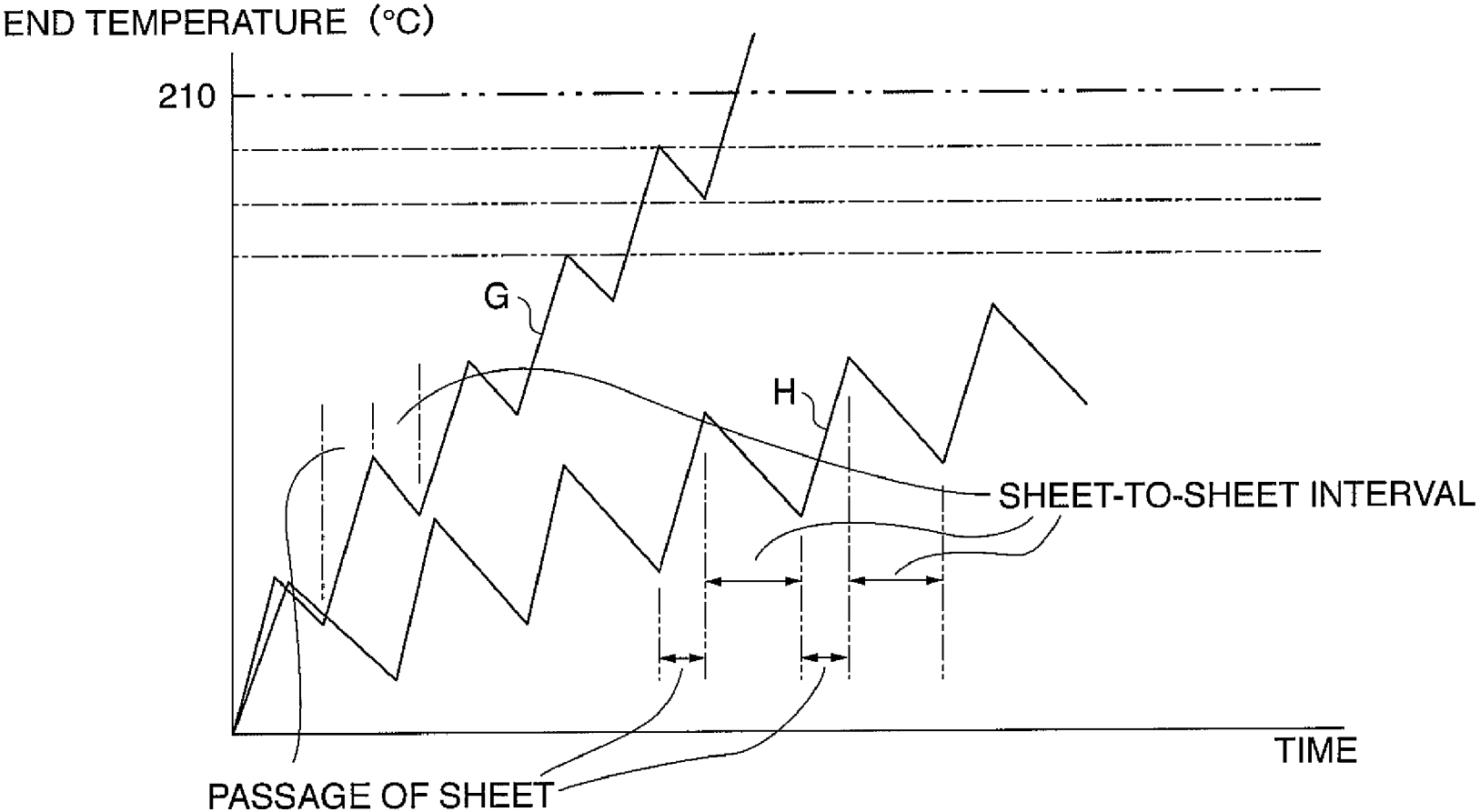
FIG. 44 is a graph showing a state in which the end temperature decreases as the sheet-to-sheet interval increases in continuous printing.
Figure 45:
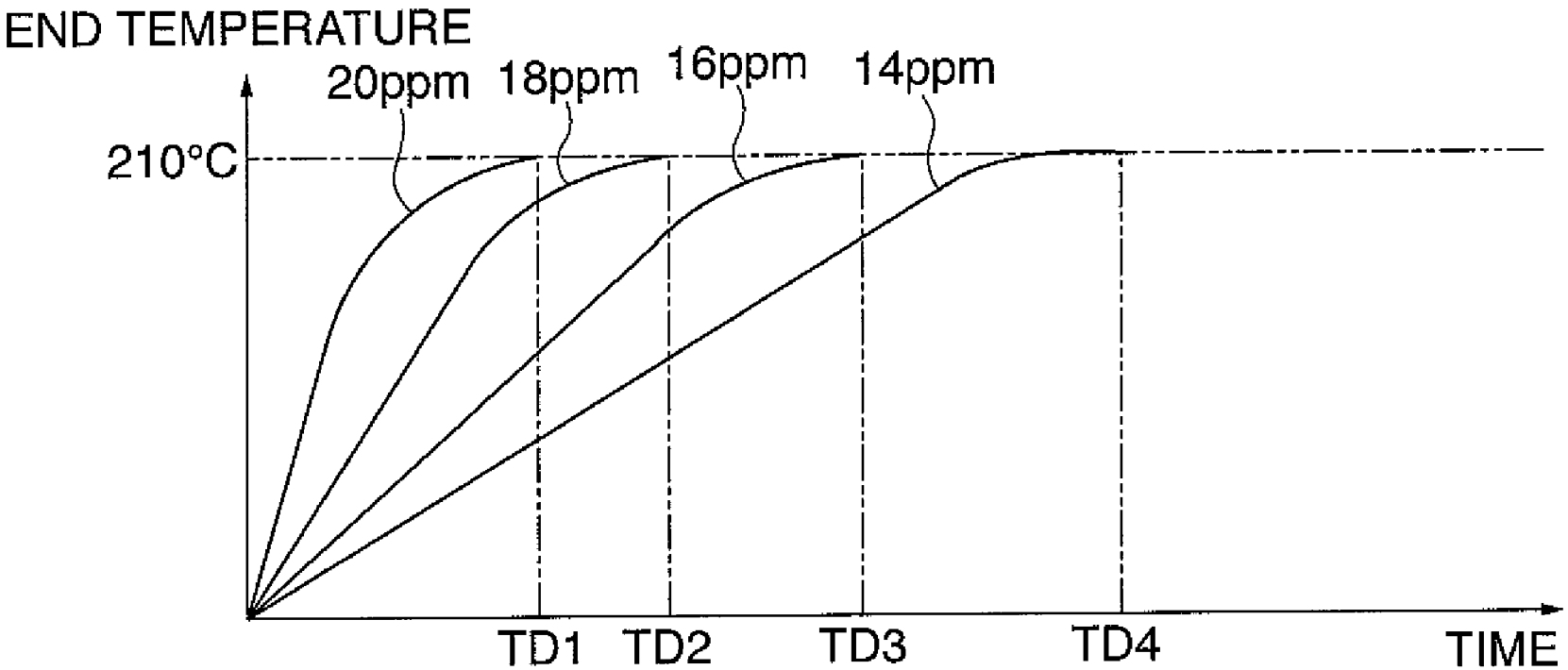
FIG. 45 is a graph showing the relationship between the throughput and the end temperature.
Figure 46:
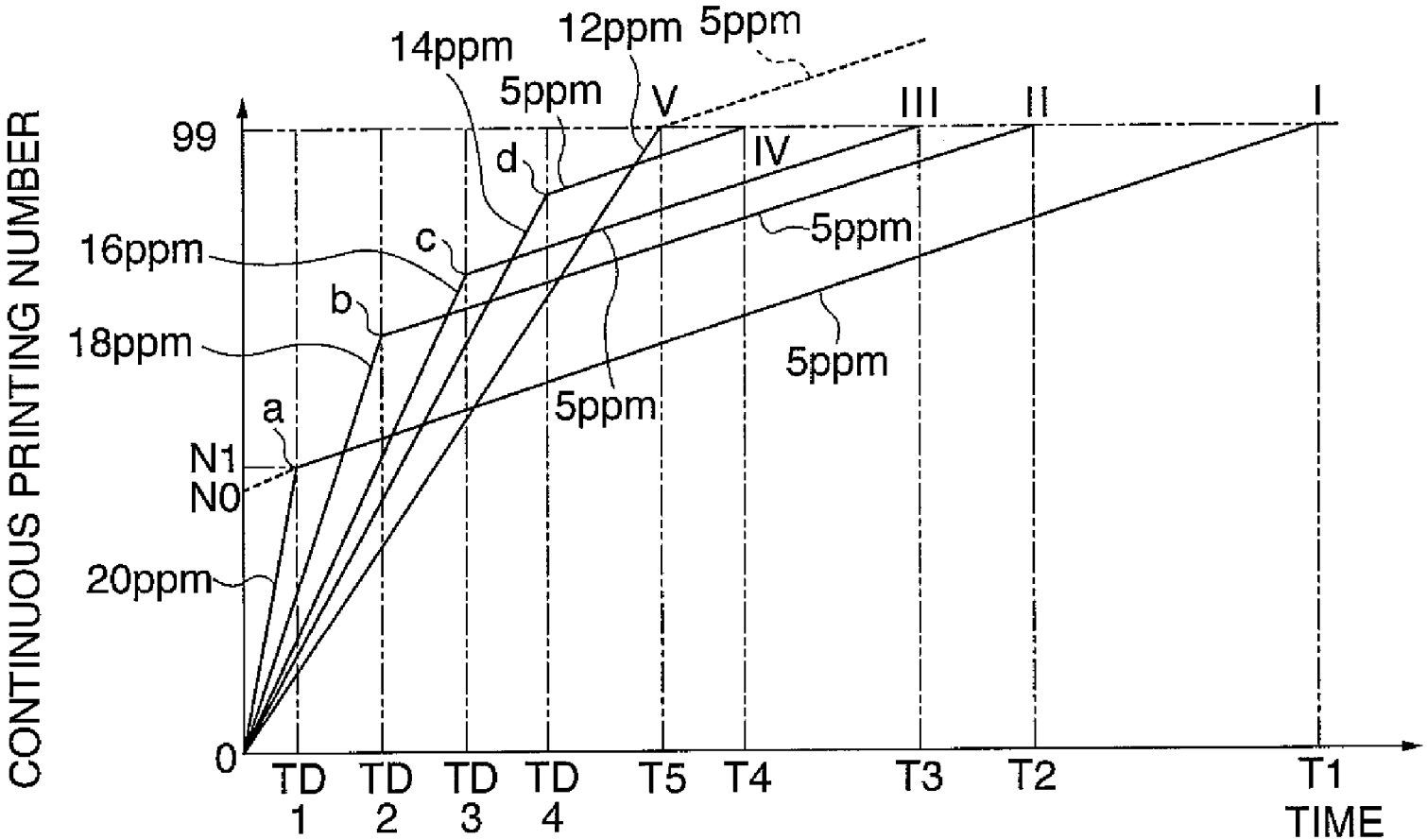
FIG. 46 is a graph showing the relationship between the continuous printing number and the printing time.

FIG. 38 is a graph showing time changes in the number of prints to be produced in the case where a large amount of heat is stored due to long-duration printing. FIG. 39 is a graph showing time changes in the number of prints to be produced in the case where the throughput is changed as shown in FIG.

38. In this case, after being decreased to 5 ppm at the upper limit, the throughput is changed to throughputs at which the end temperature intersects predetermined temperatures around 205° C., 200° C., and 195° C. in this order. Thus, the throughput is changed as follows: 20 ppm→19 ppm→16 ppm→13 ppm.

It should be understood that the present invention is not limited to the embodiments described above, but may be applied to any arrangements insofar as they can achieve the functions presented in the scope of claims or the functions achieved by the arrangements of the above described embodiments.

For example, although in the above described embodiments, the present invention is applied to the multifunction peripheral (MF) having the printing function, copying function, scanner function, and so forth, the present invention may be applied to a facsimile apparatus, a printing apparatus, or a copying apparatus which form images by an electrophotographic process.

It is to be understood that the object of the present invention may also be accomplished by supplying a system or an apparatus with a storage medium in which a program code of software, which realizes the functions of any of the above described embodiments is stored, and causing a computer (or CPU or MPU) of the system or apparatus to read out and execute the program code stored in the storage medium.

In this case, the program code itself read from the storage medium realizes the functions of any of the above described embodiments, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program code may be downloaded via a network.

Further, it is to be understood that the functions of any of the above described embodiments may be accomplished not only by executing a program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

The above-described embodiments are merely exemplary of the present invention, and are not be construed to limit the scope of the present invention.

The scope of the present invention is defined by the scope of the appended claims, and is not limited to only the specific descriptions in this specification. Furthermore, all modifications and changes belonging to equivalents of the claims are considered to fall within the scope of the present invention.

This application claims the benefit of Japanese Patent Application No. 2005-264405 filed Sep. 12, 2005, which is hereby incorporated by reference herein in its entirety.

What is claimed is:

1. An image forming apparatus including a fixing unit that comprises two roller members which form a nip section and at least one of which is heated, the fixing unit fixing an image held on a recording material when the recording material passes through the nip section, and a conveying unit that conveys the recording material to the fixing unit at a throughput representing the number of recording materials conveyed to the fixing unit per unit time, the image forming apparatus further comprising:

a throughput changing unit that, in performing continuous printing while changing a rising throughput at which a temperature at predetermined locations in the fixing unit reaches an upper limit, gradually decreases the rising throughput with a falling throughput at which the temperature at predetermined locations does not reach the upper limit interposed between throughput changes, wherein said throughout changing unit includes a changing state storage unit that stores the upper temperature limit in which the rising throughput is changed to the falling throughput, and a lower temperature limit in which the falling throughput is changed to the rising throughput, and wherein said throughout changing unit alternately carries out an operation of changing the rising throughput to the falling throughput in the upper temperature limit and an operation of changing the falling throughput to the rising throughput in the lower temperature limit.

2. An image forming apparatus according to claim 1, wherein said throughput changing unit gradually decreases the rising throughput from an initial value of the rising throughput.

3. An image forming apparatus according to claim 1, wherein said throughput changing unit selects the rising throughput based on at least one of an ambient temperature around the fixing unit, a type of the recording material, or a duration of printing.

4. An image forming apparatus according to claim 1, wherein an interval between the recording materials conveyed to the fixing unit is variable according to the predetermined throughput.

5. An image forming apparatus according to claim 1, wherein at least one of the roller members is heated by induction heating.

6. A recording material conveying method that conveys a recording material to a fixing unit in an image forming apparatus at a throughput representing the number of recording materials conveyed to the fixing unit per unit time, the fixing unit comprising two roller members which form a nip section and at least one of which is heated and fixing an image held on the recording material when the recording material passes through the nip section, the method comprising:

a throughput changing step of, in performing continuous printing while changing a rising throughput at which a temperature at predetermined locations in the fixing unit reaches an upper limit, gradually decreasing the rising throughput with a falling throughput at which the temperature at predetermined locations does not reach the upper limit interposed between throughput changes, wherein the throughout changing step includes storing, in a changing state storage unit, the upper temperature limit in which the rising throughput is changed to the falling throughput and a lower temperature limit in which the falling throughput is changed to the rising throughput, and wherein the throughout changing step alternately carries out an operation of changing the rising throughput to the falling throughput in the upper temperature limit and an operation of changing the falling throughput to the rising throughput in the lower temperature limit.

7. A computer-readable medium storing a computer program for controlling conveyance of a recording material to a fixing unit in an image forming apparatus at a throughput representing the number of recording materials conveyed to the fixing unit per unit time, the fixing unit comprising two roller members which form a nip section and at least one of which is heated and fixing an image held on the recording material when the recording material passes through the nip section, the program comprising:

a throughput changing module for, in performing continuous printing while changing a rising throughput at which a temperature at predetermined locations in the fixing unit reaches an upper limit, gradually decreasing the rising throughput with a falling throughput at which the temperature at predetermined locations does not reach the upper limit interposed between throughput changes, wherein the throughout changing module stores, in a changing state storage unit, the upper temperature limit in which the rising throughput is changed to the falling throughput and a lower temperature limit in which the falling throughput is changed to the rising throughput, and wherein the throughout changing module alternately carries out an operation of changing the rising throughput to the falling throughput in the upper temperature limit and an operation of changing the falling throughput to the rising throughput in the lower temperature limit.

* * * * *